US007740999B2

(12) United States Patent
Inaba et al.

(10) Patent No.: US 7,740,999 B2
(45) Date of Patent: Jun. 22, 2010

(54) TONER

(75) Inventors: Koji Inaba, Hadano (JP); Kazumi Yoshizaki, Suntou-gun (JP); Yasushi Katsuta, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/186,059

(22) Filed: Aug. 5, 2008

(65) Prior Publication Data

US 2009/0117483 A1 May 7, 2009

Related U.S. Application Data

(63) Continuation of application No. PCT/JP2008/057017, filed on Apr. 9, 2008.

(30) Foreign Application Priority Data

Apr. 9, 2007 (JP) ..... 2007-101922

(51) Int. Cl.
*G03G 9/087* (2006.01)

(52) U.S. Cl. ..... 430/108.5; 430/109.3; 430/111.4

(58) Field of Classification Search ..... 430/109.3, 430/111.4, 108.5
See application file for complete search history.

(56) References Cited

U.S. PATENT DOCUMENTS

| | | | | |
|---|---|---|---|---|
| 5,354,640 | A | 10/1994 | Kanbayashi et al. | |
| 5,407,776 | A | 4/1995 | Kanbayashi et al. | |
| 5,679,490 | A | 10/1997 | Yachi et al. | |
| 6,146,801 | A * | 11/2000 | Ichikawa et al. | 430/111.35 |
| 7,112,393 | B2 * | 9/2006 | Komoto et al. | 430/108.5 |
| 2009/0035688 | A1 | 2/2009 | Abe et al. | 430/110.3 |
| 2009/0130583 | A1 * | 5/2009 | Katsuta et al. | 430/108.5 |

FOREIGN PATENT DOCUMENTS

| | | |
|---|---|---|
| JP | 07-034126 | 4/1995 |
| JP | 3184626 | 4/2001 |
| JP | 2004-184561 | 7/2004 |
| JP | 2006-053353 | 2/2006 |

OTHER PUBLICATIONS

Japanese Patent Office machine-assisted translation of JP 2004-184561 (pub. Jul. 2004).
Japanese Patent Office machine-assisted translation of JP 2006-053353 (pub. Feb. 2006).

* cited by examiner

*Primary Examiner*—Janis L Dote
(74) *Attorney, Agent, or Firm*—Fitzpatrick, Cella, Harper & Scinto

(57) ABSTRACT

To achieve improvements in developing performance, transferring performance, and fixing performance, a toner has a glass transition temperature (TgA) of 40 to 60° C. and a temperature (P1) of the highest peak of 70 to 120° C.; cyclohexane (CHX) insoluble matter in the tetrahydrofuran (THF) soluble matter of the toner has a glass transition temperature (TgB) of 80 to 120° C.; TgA and TgB satisfy a specific formula; the toner has a viscosity at 100° C. of 5,000 to 30,000 Pa·s; and the cyclohexane (CHX) insoluble matter has an acid value of 5 to 40 mgKOH/g.

21 Claims, 4 Drawing Sheets

TONER

BACKGROUND OF THE INVENTION

1. Field of the Invention

The present invention relates to a toner to be used in an image-forming method such as an electrophotographic method, an electrostatic recording method, an electrostatic printing method, or a toner jet method.

2. Description of the Related Art

High reliability and consideration for the environment have been strongly requested of a printer or copying machine in recent years.

The term "high reliability" means not only that the printer or copying machine can continue to output images at levels comparable to that of an initial image even when images are printed with the printer or copying machine over a long time period but also that the printer or copying machine is user-friendly. To be specific, the printer or copying machine is requested to maintain good developing performance, good transferring performance, and good winding resistance irrespective of the environment under which the printer or copying machine is used and irrespective of what kind of a transfer material is used. In addition, the term "consideration for the environment" means that the printer or copying machine is requested to be capable of being driven with a low power consumption so as to respond to energy savings. To be specific, the printer or copying machine is requested to have good low-temperature fixability.

A color toner obtained by subjecting a polymerizable mixture containing styrene and α-methylene aliphatic monocarboxylates for producing polar and non-polar polymers to suspension polymerization has been proposed with a view to improving transparency in an OHP sheet. The proposal discloses a color toner having the characteristics (see Patent Document 1) that the toner contains a mixture of a polar polymer and a non-polar polymer as a binder resin, the polar polymer is unevenly distributed on the surfaces of the particles of the toner, and the toner has a Wardell sphericity of 0.95 to 1.00 and a melt viscosity at 130° C. of 10 to 33,000 poises.

A proposal has been made with a view to obtaining a toner having the characteristics that the toner is excellent in blocking resistance even under a high-temperature, high-humidity environment, allows images to be fixed at low temperatures, is excellent in releasing performance, stably shows high developing performance, provides an image having a high image density, and shows a suppressed change in its performance even when the toner is used over a long time period. The proposal describes toner particles each containing at least two kinds of components including a high-softening-point resin (A) and a low-softening-point substance (B) and each having a structure separated into an A phase mainly formed of the high-softening-point resin (A) and a B phase mainly formed of the low-softening-point substance (B) (see Patent Document 2).

A toner for image formation having the following characteristic has also been proposed with a view to securing pulverizing performance, heat-resistant storage stability, offset resistance, transferring performance, low-temperature fixability, and flaw resistance (see Patent Document 3): at least one exothermic peak is present around the glass transition point of the binder resin of the toner in the second temperature increase process of the DSC curve of the toner.

Further, a toner having the following characteristics has been proposed with a view to securing gloss, color reproducibility, and the uniform stability of image gloss (see Patent Document 4): the binder resin of the toner has a weight-average molecular weight of 8,000 to 50,000 and a glass transition point of 40 to 55° C., and a thermoplastic resin having a weight-average molecular weight twice or more as high as that of the binder resin and a glass transition point higher than that of the binder resin by 5° C. or more is present near the surface of the toner.

Patent Document 1: JP 07-34126 B
Patent Document 2: JP 03184626 B
Patent Document 3: JP 2004-184561 A
Patent Document 4: JP 2006-053353 A

SUMMARY OF THE INVENTION

An object of the present invention is to achieve improvements in the developing performance, transferring performance, and fixing performance of toner.

The present invention is as described below.

The present invention provides a toner including toner particles each containing at least a binder resin, a wax, and a colorant, characterized in that:

the toner has (i) a glass transition temperature (TgA) measured with a differential scanning calorimeter of 40 to 60° C., (ii) a peak temperature (P1) of a highest endothermic peak measured with a differential scanning calorimeter of 70 to 120° C., and (iii) a viscosity at 100° C. measured by a flow tester heating method of 5,000 to 30,000 Pa·s;

cyclohexane (CHX) insoluble matter in tetrahydrofuran (THF) soluble matter of the toner has (i) a glass transition temperature (TgB) measured with a differential scanning calorimeter of 80 to 120° C. and (ii) an acid value of 5 to 40 mgKOH/g; and the glass transition temperature (TgA) and the glass transition temperature (TgB) satisfy the following formula (1).

$$25^\circ\text{ C.} \leqq (TgB - TgA) \leqq 70^\circ\text{ C.} \qquad \text{Formula (1)}$$

According to the present invention, improvements in the developing performance, transferring performance, and fixing performance of toner can be achieved.

Further features of the present invention will become apparent from the following description of exemplary embodiments (with reference to the attached drawings).

DESCRIPTION OF REFERENCE NUMERALS

Figure 1:
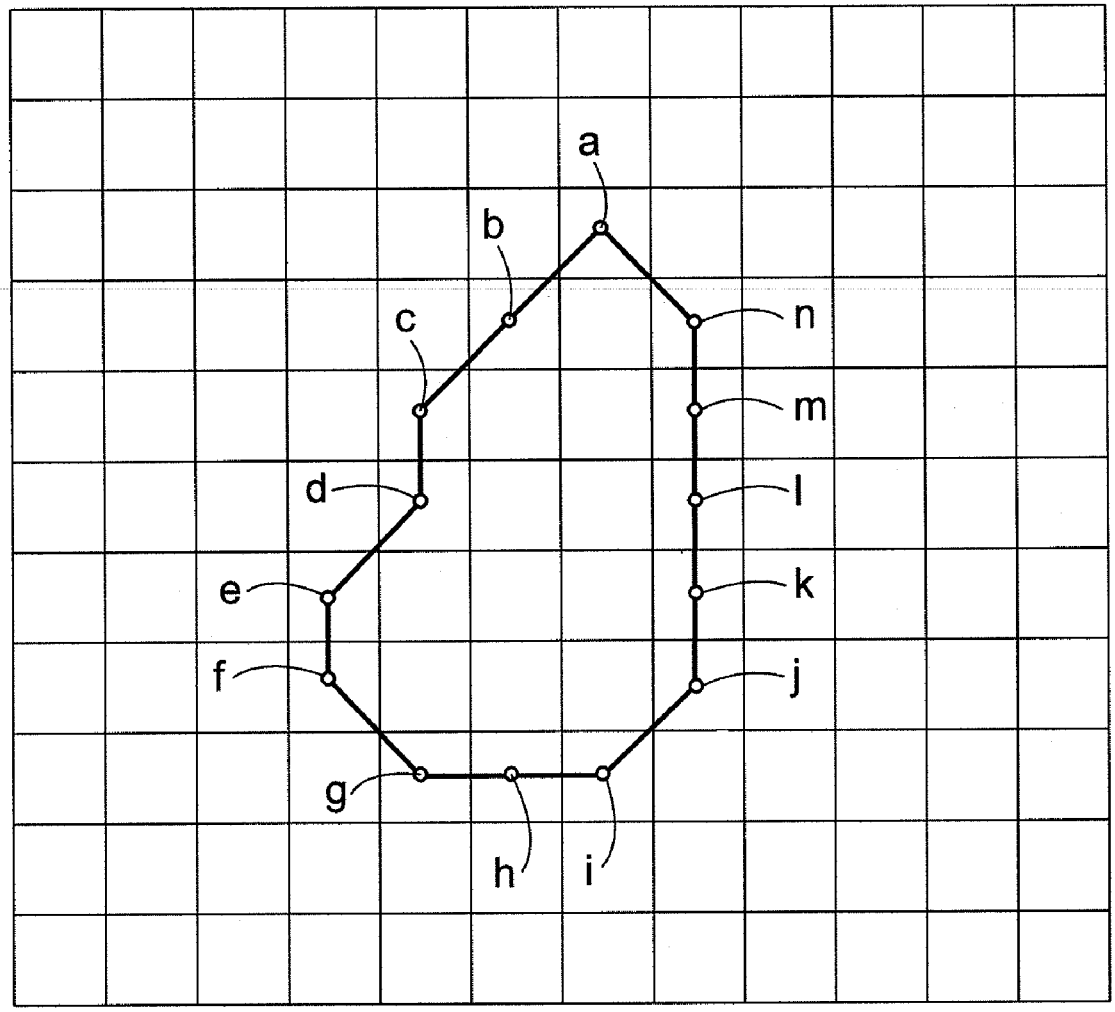
FIG. 1 shows an example of a binarized image obtained by binarizing image data at a certain appropriate threshold level.

10: photosensitive drum
11: electrostatic latent image bearing member contact charger
12: power supply
13: developing unit
14: toner carrying member
15: toner feeding roller
16: control member
17: non-magnetic toner
23: developer container

24: control member support plate
25: toner transport member
27: bias
101 (101*a* to 101*d*): drum type electrophotographic photosensitive member (photosensitive drum)
103*a*: laser beam exposing devise (scanner)
104*a*: developing: portion
106 (106*a* to 106*d*): cleaning devise
108*b*: sheet feeding roller
108*c*: resist roller
109*a*: electrostatic adsorption transport belt
109*b*: driver roller
109*c*: fixed roller
109*d*: tension roller
109*e*: fixed roller
110: fixing unit
110*c*: discharge roller
113: discharge tray
S: transfer material (recording medium)

DESCRIPTION OF THE EMBODIMENTS

A toner of the present invention has improved developing performance, improved transferring performance, and improved fixing performance.

An improvement in developing performance of the toner means the following three points:

(1) the toner has high resistance (toughness) against rubbing between a toner control member and a toner carrying member, shows a small change in its charging characteristic even when images are continuously output, and hence can maintain high developing efficiency;
(2) the occurrence of a circumferential streak resulting from the interposition of broken toner between the toner control member and the toner carrying member or from the occurrence of the melt adhesion of the toner can be favorably suppressed, and toner scattering resulting from the interposition of broken toner between the toner carrying member and a toner edge seal can be favorably suppressed; and
(3) a toner coat amount is uniform along the longitudinal direction of the toner carrying member, and a developer can be uniformly fed to a developing zone.

In addition, an improvement in transferring performance of the toner means the following three points:

(1) the transfer efficiency of the toner can be maintained at a high level identical to that of initial transfer efficiency even when images are continuously output;
(2) the toner is transferred onto a transfer material with high uniformity in one page; and
(3) the toner can be uniformly transferred onto even a transfer material having low smoothness.

In addition, an improvement in fixing performance of the toner means the following two points:

(1) the toner can secure low-temperature fixability even in a low-pressure fixing system; and
(2) the winding of a transfer material around a fixing member at high temperatures can be suppressed.

Hereinafter, the toner of the present invention will be described.

A capsule type toner is preferable in order that such toner with improved developing performance, improved transferring performance, and improved fixing performance as described above may be obtained. The capsule type toner generally has such a structure that an inner layer is protected by an outer layer. However, in the case where adhesiveness between the inner layer and the outer layer is weak, when a stress is continuously applied to the toner upon continuous output of images, the outer layer is peeled or shaved, so the surface property of each of the particles of the toner may abruptly change at a certain time point.

In addition, the following has been found: when a resin containing cyclohexane insoluble matter and compatible with a resin for the inner layer is used as a resin for the outer layer, the outer layer can be formed while adhesiveness between the inner layer and the outer layer is sufficiently secured, and such abrupt change can be suppressed.

It should be noted that cyclohexane shows high solubility in a polymer free of polarity, but shows low solubility in a polymer having polarity because cyclohexane is hardly soluble in a polar solvent. Accordingly, the dissolution of resins in cyclohexane can result in the separation of the resins into a resin free of polarity and a resin having polarity. That is, a state where the toner contains a resin component insoluble in cyclohexane in its THF soluble matter means that the toner contains a resin having polarity.

In addition, a binder resin component of which the inner layer is formed and a polar resin of which the outer layer is formed are preferably of the same kind in order that compatibility between the inner layer and the outer layer may be improved. The expression "of the same kind" means, for example, that both the resins are vinyl resins or polyester resins.

The inventors of the present invention have the following thought: when a resin having polarity and compatible with a binder resin of which the inner layer is formed is used, compatibilization occurs at an interface between the resin having polarity and the binder resin, so the concentration gradient of the resin having polarity arises at the interface.

For example, when the toner particles are produced by a suspension polymerization method in an aqueous medium, the polar resin dissolved in a monomer shows reduced solubility in the monomer as a polymerization reaction proceeds, with the result that phase separation occurs. At that time, the polar resin is unevenly distributed on the surfaces of droplets owing to an influence of the polarity. However, the polar resin and the binder resin component are compatible, so no clear interface is formed between both the components, and the polar resin is present so as to have such a concentration gradient that the concentration of the polar resin gradually reduces, and the concentration of the binder resin component gradually increases, from the surface of each of the particles toward the inside of the particle.

With such procedure, the adhesiveness between the inner layer and outer layer of the toner is improved, and the toughness of the toner is strengthened, so the breakdown of the toner hardly occurs, and the developing performance and transferring performance of the toner are improved. In addition, upon dissolution of a wax in a fixing step, the wax can rapidly move toward the surface of each of the toner particles with ease, whereby the fixing performance of the toner is also improved.

The inventors of the present invention consider that the developing performance, transferring performance, and fixing performance of the toner of the present invention are improved because: the inner layer and outer layer of the toner show high adhesiveness; the toner shows high toughness against an external factor at the time of pressurization; and the wax shows good bleeding performance when the toner is heated.

In addition, the toner of the present invention has a glass transition temperature (TgA) measured with a differential scanning calorimeter in the range of 40 to 60° C. In this case, the adhesive force of the binder resin to a transfer material is improved when the toner is heated and pressurized. Accordingly, the low-temperature fixability of the toner can be improved. In addition, the above effect becomes additionally significant when the glass transition temperature (TgA) of the toner is 45 to 60° C. When TgA is lower than 40° C., detrimental effects on the developing performance and transferring performance of the toner arise. When TgA exceeds 60° C., the toner is poor in low-temperature fixability. In addition, the condition for TgA can be satisfied by adjusting, for example, the composition ratio of a polymerizable monomer of which the toner is formed.

Cyclohexane insoluble matter in the THF soluble matter of the toner of the present invention has a glass transition temperature (TgB) measured with a differential scanning calorimeter of 80 to 120° C. As described above, the cyclohexane insoluble matter mainly contains a resin having polarity, and the outer layer is mainly formed of the resin having polarity. When the glass transition temperature. TgB of the component is 80 to 120° C., the strength of the outer layer of the toner can be increased, so the toughness of the toner is improved. As a result, the resistance of the toner against a stress at the time of development is strengthened, whereby the developing efficiency of the toner can be improved. Further, circumferential streaks and toner scattering are reduced, so the transfer efficiency of the toner can be additionally improved. In addition, the above effects become additionally significant when TgB is 85 to 110° C. In addition, the condition for the glass transition temperature (TgB) of the toner can be satisfied by adjusting, for example, a monomer composition ratio at the time of the production of the polar resin as a raw material for the toner because TgB is affected by the physical properties of the polar resin.

The toner of the present invention has a peak temperature (P1) of the highest endothermic peak measured with a differential scanning calorimeter of 70 to 120° C., or preferably 70 to 90° C. The endothermic peak reflects the endothermic characteristic of the wax in the toner. When P1 is 70 to 120° C., the wax has moderate bleeding performance, so the occurrence of the winding of a transfer material around a fixing member when the temperature of the atmosphere surrounding the transfer material becomes high at the time of fixation can be suppressed. Further, the wax exerts a plasticizing effect on the Loner to improve the adhesive force of the toner to paper, so the low-temperature fixability of the toner is improved.

In addition, a temperature difference (TgB−TgA) between TgB and TgA is 25 to 70° C., or preferably 30 to 70° C. When the temperature difference between TgB and TgA is 25 to 70° C., compatibility between the low-temperature fixability and developing performance of the toner can be favorably achieved. Further, the occurrence of a circumferential streak and toner scattering are reduced, so the transfer efficiency of the toner can be additionally improved, and an image to be obtained has high uniformity in one page. Further, uniform transferring performance can be obtained even in the case of a transfer material having low smoothness. Further, the adhesive force of the toner to paper is improved, whereby the low-temperature fixability of the toner is improved. In addition, the above effects become additionally significant when the temperature difference between TgB and TgA is 30 to 70° C.

A temperature difference (P1−TgA) between P1 and TgA is preferably 15 to 70° C. When the temperature difference between P1 and TgA is 15 to 70° C., the wax bleeds to the surface of the toner in an additionally suitable fashion, so the occurrence of the winding of a transfer material around a fixing member is suppressed even when the temperature of the atmosphere surrounding the transfer material becomes high at the time of fixation. Further, the adhesive force of the toner to paper is improved, so the low-temperature fixability of the toner is improved. The above effects become additionally significant when the temperature difference between P1 and TgA is 15 to 50° C., or especially 20 to 50° C.

In addition, the toner of the present invention has a viscosity at 100° C. measured by a flow tester heating method of 5,000 to 30,000 Pa·s. When the viscosity falls within the above range, the wax exudes to a moderate extent, so the winding of a transfer material around a fixing member can be favorably suppressed. Further, the adhesive force of the toner to paper is improved, so the low-temperature fixability of the toner is improved. The viscosity is preferably 5,000 to 25,000 Pa·s, and, in this case, the above effects become additionally significant. In addition, when the toner is a polymerized toner, the condition for the melt viscosity of the toner can be satisfied by adjusting, for example, polymerization conditions (such as a temperature, and the kind and amount of an initiator).

The content of the cyclohexane (CHX) insoluble matter in the THF soluble matter of the toner of the present invention is preferably 3 to 30 mass %. When the content of the cyclohexane insoluble matter falls within the above range, the strength of the outer layer of the toner can be increased, so the toughness of the toner is improved. As a result, the resistance of the toner against a stress at the time of development is strengthened, whereby the developing efficiency of the toner can be improved. Further, circumferential streaks and toner scattering are reduced. Further, the transfer efficiency of the toner can be improved. When the content of the cyclohexane insoluble matter is 5 to 30 mass %, the above effects become additionally significant. In addition, the cyclohexane insoluble matter is affected by the amount of the polar resin as a raw material for the toner, so the condition for the content of the cyclohexane insoluble matter can be satisfied by adjusting, for example, the amount in which the polar resin is loaded at the time of the production of the toner.

The cyclohexane insoluble matter in the THF soluble matter of the toner of the present invention has an acid value of 5 to 40 mgKOH/g. When the acid value of the cyclohexane insoluble matter is 5 to 40 mgKOH/g, the strength of the outer layer of the toner can be increased. As a result, the toughness of the toner is improved. Accordingly, the resistance of the toner against a stress is strengthened, whereby the developing efficiency of the toner can be improved. Further, circumferential streaks and toner scattering are reduced, so the transfer efficiency of the toner can be additionally improved. When the acid value of the cyclohexane insoluble matter is 5 to 25 mgKOH/g, the above effects become additionally significant. In addition, the acid value of the cyclohexane insoluble matter is affected by the acid value of the polar resin as a raw material for the toner, so the condition for the acid value of the cyclohexane insoluble matter can be satisfied by adjusting, for example, the kind and usage of the monomer at the time of the production of the polar resin.

When a dispersion liquid prepared by dispersing the toner particles in an aqueous medium free of a dispersion stabilizer is stirred at a temperature higher than the glass transition temperature (TgA) of the toner by 5° C. for 60 minutes, the toner of the present invention has a change ratio represented by the following equation of a weight-average particle diameter (D4) of the toner particles after the stirring under heat to the weight-average particle diameter before the stirring under heat of preferably 100 to 150%.

Change ratio of weight-average particle diameter (*D*4) (%)=(weight-average particle diameter of toner particles after stirring under heat/weight-average particle diameter of toner particles before stirring under heat)×100

When the change ratio of the weight-average particle diameter (D4) is 100 to 1.50%, the toner has high toughness and high resistance against a stress, so the triboelectric charging characteristic of the toner changes to a small extent even when images are continuously output, and high developing efficiency can be stably obtained. Further, the occurrence of a circumferential streak resulting from the interposition of broken toner between the toner control member and the toner carrying member or from the occurrence of the melt adhesion of the toner can be favorably suppressed, and toner scattering resulting from the interposition of broken toner between the toner carrying member and a toner edge seal can be favorably suppressed. When the change ratio of the weight-average particle diameter (D4) is 100 to 130%, the above effects become additionally significant. In addition, the condition for the change ratio of D4 can be satisfied by adjusting, for example, the amount in which the polar resin is loaded, and the molecular weight and glass transition temperature of the polar resin.

The toner of the present invention has a degree of agglomeration after the toner has been left to stand at a temperature of 50° C. and a humidity of 10% for 3 days of preferably 50 or less, or more preferably 30 or less. When the degree of agglomeration is 50 or less, the bleeding of the wax at the time of the storage of the toner can be favorably suppressed, and the respective toner particles can be provided with uniform charging performance. As a result, the property with which the upper portion of the toner carrying member is uniformly coated with the toner can be obtained. Further, the toughness of the toner is improved, and the resistance of the toner against a stress at the time of development is strengthened, whereby the developing efficiency of the toner can be improved. Further, circumferential streaks and toner scattering are reduced. In addition, the condition for the degree of agglomeration can be satisfied by adjusting, for example, the amount in which the polar resin is loaded, the molecular weight of the polar resin, the amount in which the wax is loaded, and the melting point of the wax.

It should be noted that the degree of agglomeration in the present invention is a value measured by the following method.

A sieve having an aperture of 250 μm, a sieve having an aperture of 500 μm, and a sieve having an aperture of 710 μm are set like a laminate in the stated order from below on the vibrating table of a vibrating sifter Powder Tester (manufactured by Hosokawa Micron Corporation). Then, 5 g of a sample left to stand under a normal-temperature, normal-humidity environment for 1 day are placed on the sieve having an aperture of 710 μm, and are vibrated for about 10 seconds while an voltage to be input to the vibrating table is adjusted to 15 V and the amplitude of the vibrating table at the time of the vibration is adjusted to fall within the range of 60 to 90 μm. After that, the mass of the sample remaining on each sieve is measured, and the degree of agglomeration is obtained on the basis of the following equation. It should be noted that the smaller the degree of agglomeration, the higher the flowability of the toner.

Degree of agglomeration={(mass (g) of sample on sieve having aperture of 710 μm)/5 (g)}×100+{(mass (g) of sample on sieve having aperture of 500 μm)/5 (g)}×100×0.6+{(mass (g) of sample on sieve having aperture of 250 μm)/5 (g)}1×100×0.2

The toner of the present invention has an average circularity measured with a flow-type particle image analyzer of preferably 0.960 to 1.000, or more preferably 0.970 to 1.000. Setting the average circularity within the above range allows a flowability improver to adhere uniformly to the surface of each of the toner particles with no unevenness, so the toner can be uniformly transferred onto even a transfer material having low smoothness. Further, setting the average circularity within the above range can improve the ease with which the toner is subjected to closest packing and provide the respective toner particles with uniform charging performance, so a uniform toner coat can be formed on the toner carrying member. In addition, the condition for the average circularity of the toner can be satisfied by adjusting, for example, a temperature and the amount in which a dispersion stabilizer is loaded at the time of the production of the toner particles.

The toner of the present invention contains particles each having a particle diameter equal to or less than one third of the weight-average particle diameter (D4) of the toner at a ratio (small-particle ratio) of preferably 20 number % or less, or more preferably 10 number % or less. Suppressing the small-particle ratio can suppress the contamination of a member involved in development. In addition, the suppression can provide the respective toner particles with uniform charging performance and allow a uniform toner coat to be formed on the toner carrying member. Further, the suppression can improve the resistance of the toner against a stress, so, in particular, high developing efficiency can be obtained. In addition, the suppression can suppress the occurrence of a circumferential streak and reduce toner scattering. Moreover, the suppression can provide an image with high uniformity in one page. In addition, the condition for the small-particle ratio can be satisfied by adjusting, for example, the amount in which the dispersion stabilizer is loaded and the hydrogen ion concentration index (pH) at the time of the production of the toner particles.

In addition, a penetration thickness (L) at a penetration time of 5 seconds when a UV curable composition is caused to penetrate into the toner of the present invention is preferably 0.20 to 0.60 μm, or more preferably 0.30 to 0.50 μm. In addition, an average penetration velocity (Va) at a penetration time of 5 seconds or more and 10 seconds or less when the UV curable composition is caused to penetrate into the toner is preferably 0.020 to 0.070 μm/s. Further, an average penetration velocity (Vb) at a penetration time of 10 seconds or more and 15 seconds or less is preferably higher than the average penetration velocity (Va) at a penetration time of 5 seconds or more and 10 seconds or less.

The inventors of the present invention consider that the velocity at which the UV curable composition penetrates into the resin of the toner reflects the mobility of the molecular chain of the resin. That is, the inventors assume that the higher the mobility of the molecular chain of the resin, the higher the above penetration velocity, while the lower the mobility of the molecular chain, the lower the above penetration velocity. In addition, the toner easily melts at the time of fixation and the wax easily exudes to the surface of the toner when a resin having the following characteristics is used: the molecular chain of the resin shows high mobility, and the composition penetrates into the resin at a high velocity. However, such resin reduces the resistance of the toner against a stress and the heat resistance of the toner. In contrast, the toner shows high resistance against a stress and high heat resistance, but hardly melts at the time of fixation, and the wax hardly exudes to the surface of the toner when a resin having the following characteristics is used: the molecular chain of the resin shows low mobility, and the composition penetrates into the resin at a low velocity. That is, a resin having the following characteristic is suitably used as a resin of which the inner layer of the toner is formed: the composition penetrates into the resin at a high velocity. Similarly, a resin having the following characteristic is suitably used as a resin of which the outer layer of the toner is formed: the composition penetrates into the resin at a low velocity.

The inventors consider that the penetration thickness (L) at a penetration time of 5 seconds reflects the penetration velocity near the surface of the toner and that the average penetration velocity (Va) at a penetration time of 5 seconds or more and 10 seconds or less is an indicator representing the penetration velocity on the surface side of the outer layer of the toner and the average penetration velocity (Vb) at a penetration time of 10 seconds or more and 15 seconds or less is an indicator representing the penetration velocity inside the outer layer of the toner.

When the penetration thickness (L) falls within the above range, the outermost layer portion of the toner is strong, so the toner can obtain sufficient toughness. In addition, the bleeding performance of the wax at the time of fixation is improved. As a result, the developing performance and fixing performance of the toner are improved. Accordingly, the storage stability of the toner is improved.

When the average penetration velocity (Va) at a penetration time of 5 seconds or more and 10 seconds or less falls within the above range, the mobility of the molecular chain of the resin in the outer layer of the toner falls within an optimum range, so the toner can obtain sufficient toughness, and the wax can obtain good bleeding performance at the time of fixation. As a result, the developing characteristic and fixing characteristic of the toner are improved.

Further, when Va and Vb satisfy the relationship of Va<Vb, the resin of which the outer layer of the toner is constituted is present so as to have a concentration gradient from the vicinity of the surface of the toner toward the inside of the toner, whereby the adhesiveness between the inner layer and outer layer of the toner is improved. As a result, the developing characteristic and low-temperature fixability of the toner are improved.

Setting L, Va, and Vb of the toner within the above ranges improves adhesiveness between the binder resin present mainly in the inner layer of the toner and the polar resin present mainly in the outer layer of the toner. Further, in this case, the resin of which the outer layer of the toner is constituted is present so as to have a concentration gradient from the vicinity of the surface layer of the toner toward the inside of the toner. As a result, the peeling or shaving of the outer layer of the toner hardly occurs when a stress is applied to the toner owing to the continuous output of images. Accordingly, high developing efficiency, a reduction in number of circumferential streaks, and the reduction of toner scattering can be achieved. In addition, the inner layer of the toner can be designed so as to be sufficiently soft because the inner layer of the toner is hardly exposed by virtue of the above characteristics even when a stress is persistently applied to the toner owing to the continuous output. Further, the absence of an interface between the inner layer and outer layer of the toner improves the bleeding performance of the wax at the time of fixation. Accordingly, the toner can achieve good low-temperature fixability, and a transfer material can be prevented from winding around a fixing member at high temperatures while none of the developing characteristic and storage stability of the toner is reduced.

It should be noted that the inventors of the present invention assume that the glass transition temperature Tg, degree of crosslinking, molecular weight, and the like of a resin act in combination to determine the penetration velocity. In addition, the conditions for L, Va, and Vb of the toner can be satisfied by adjusting, for example, the composition ratio of the polymerizable monomer of which the toner is formed and by reducing a compositional difference between the binder resin and the polar resin.

In addition, the molecular weight (MpA) of a main peak in the molecular weight distribution of the tetrahydrofuran (THF) soluble matter of the toner of the present invention measured by gel permeation chromatography (GPC) is preferably 10,000 to 40,000. When MpA is 10,000 to 40,000, the occurrence of the winding of a transfer material around a fixing member is suppressed by virtue of the moderate bleeding performance of the wax even when the temperature of the atmosphere surrounding the transfer material becomes high at the time of fixation. Further, the adhesive force of the toner to paper is improved, and the low-temperature fixability of the toner is improved. In addition, the above effects become additionally significant when MpA is 15,000 to 35,000. In addition, the condition for MpA can be satisfied by adjusting, for example, polymerization conditions at the time of the production of the toner (such as a temperature, and the kind and amount of an initiator).

The molecular weight (MpB) of a main peak in the molecular weight distribution of the cyclohexane insoluble matter in the THF soluble matter of the toner of the present invention measured by GPC is preferably 10,000 to 250,000. When MpB is 10,000 to 250,000, the strength of the outer layer of the toner is increased. As a result, the toughness of the toner is improved, and the resistance of the toner against a stress is strengthened, whereby the developing efficiency of the toner can be improved. Further, circumferential streaks and toner scattering are reduced, so the transfer efficiency of the toner can be additionally improved. In addition, the above effects become additionally significant when MpB is 10,000 to 100,000. In addition, the condition for MpB can be satisfied by adjusting, for example, polymerization conditions at the time of the production of the polar resin (such as a temperature, and the kind and amount of an initiator) and the polymerization conditions at the time of the production of the toner (such as a temperature, and the kind and amount of an initiator).

The weight-average particle diameter (D4) of the toner of the present invention is preferably 4.0 to 9.5 μm, or more preferably 4.5 to 8.5 μm. The ease with which a high-definition image is obtained is improved when the weight-average particle diameter falls within the above range.

Hereinafter, a material to be used in the present invention will be described.

As a binder resin that can be used in the present invention, there are given, for example: polystyrene; monopolymers of styrene substituents, such as poly-p-chlorstyrene and polyvinyltoluene; styrene copolymers such as a styrene-p-chlorstyrene copolymer, a styrene-vinyltoluene copolymer, a styrene-vinylnaphthaline copolymer, a styrene-acrylate copolymer, a styrene-methacrylate copolymer, a styrene-α-chlormethyl methacrylate copolymer, a styrene-acrylonitrile copolymer, a styrene-vinylmethyl ether copolymer, a styrene-vinylethyl ether copolymer, a styrene-vinylmethyl ketone copolymer, a styrene-butadiene copolymer, a styrene-isoprene copolymer, and a styrene-acrylonitrile-indene copolymer; an acrylic resin; a methacrylic resin; polyvinylacetate; a silicone resin; a polyester resin; a polyamide resin; a furan resin; an epoxy resin; and a xylene resin. Those resins are used alone or used in mixture.

As a comonomer to a styrene monomer of the styrene copolymer, there are given, for example: monocarboxylic acids or its substituents each having a double bond, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids or its substituents each having a double bond, such as maleic acid, butyl maleate, methyl maleate, and dimethyl maleate; vinyl esters such as vinyl chloride, vinyl acetate, and vinyl benzoate; ethylene olefins such as ethylene, propylene, and butylene; vinyl ketones such as vinylmethyl ketone and vinylhexyl ketone; and vinyl ethers such as vinylmethyl ether, vinylethyl ether, and vinylisobutyl ether. Those vinyl monomers are used alone or two or more of them are used.

As a polymerizable monomer to be used in producing the toner of the present invention by a polymerization method, a vinyl polymerizable monomer capable of being radical polymerized is used. As the vinyl polymerizable monomer, a monofunctional polymerizable monomer or a polyfunctional polymerizable monomer may be used. Examples of the monofunctional polymerizable monomer include: styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene; acrylic polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethylphosphate ethylacrylate, diethylphosphate ethylacrylate, dibutylphosphate ethylacrylate, and 2-benzoyloxy ethylacrylate; methacrylic polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethylphosphate ethylmethacrylate, and dibutylphosphate ethylmethacrylate; methylene aliphatic monocarboxylate; vinyl esters such as vinyl acetate, vinyl propionate, vinyl butyrate, vinyl benzoate, and vinyl formate; vinyl ethers such as vinylmethyl ether, vinylethyl ether, and vinylisobutyl ether; and vinyl ketones such as vinylmethyl ketone, vinylhexyl ketone, and vinylisopropyl ketone.

Examples of the polyfunctional polymerizable monomer include diethyleneglycol diacrylate, triethyleneglycol diacrylate, tetraethyleneglycol diacrylate, polyethyleneglycol diacrylate, 1,6-hexanediol diacrylate, neopentylglycol diacrylate, tripropyleneglycol diacrylate, polypropyleneglycol diacrylate, 2,2'-bis(4-(acryloxy/diethoxy)phenyl)propane, trimethylolpropane triacrylate, tetramethylolmethane tetraacrylate, ethyleneglycol dimethacrylate, diethyleneglycol dimethacrylate, triethyleneglycol dimethacrylate, tetraethyleneglycol dimethacrylate, polyethyleneglycol dimethacrylate, 1,3-butyleneglycol dimethacrylate, 1,6-hexanediol dimethacrylate, neopentylglycol dimethacrylate, polypropyleneglycol dimethacrylate, 2,2'-bis(4-(methacryloxy/diethoxy)phenyl)propane, 2,2'-bis(4-(methacryloxy/polyethoxy)phenyl)propane, trimethylolpropane trimethacrylate, tetramethylolmethane tetramethacrylate, divinyl benzene, divinyl naphthaline, and divinyl ether.

In the present invention, one kind of the above-mentioned monofunctional polymerizable monomers can be used alone, or two or more kinds of them can be used in combination. Alternatively, one or more kinds of the above-mentioned monofunctional polymerizable monomers and one or more kinds of the above-mentioned polyfunctional polymerizable monomers can be used in combination. Each of the polyfunctional polymerizable monomers can be used also as a crosslinking agent.

In addition, upon production of the toner by a suspension polymerization method, a monomer of which the toner is formed is preferably selected in such a manner that the glass transition temperature of a binder resin obtained by the polymerization of the monomer is lower than the glass transition temperature of the toner. In addition, the glass transition temperature of the toner to be obtained is preferably set within the range specified in the present invention by increasing the glass transition temperature of a polar resin of which the outer layer of the toner is mainly formed. As a result, the developing performance, transferring performance, and fixing performance of the toner can be improved while the heat resistance of the toner which tends to reduce when the glass transition temperature of the binder resin is set to a low temperature is favorably maintained.

As described above, in the present invention, a resin which is compatible with the binder resin and has polarity is preferably used as a resin for forming the outer layer. To be specific, a resin having the same composition as that of the binder resin is preferably used. Further, a resin having such physical properties as described below is preferable: cyclohexane insoluble matter in the tetrahydrofuran soluble matter of the resin has a main peak molecular weight (MpB), a glass transition temperature (TgB), and an acid value which fall within the above ranges. Specific examples of such preferable resin include: nitrogen-containing monomers such as dimethylaminoethyl methacrylate and diethylaminoethyl methacrylate; nitrile monomers such as acrylonitrile; halogen-containing monomers such as vinyl chloride; unsaturated carboxylic acids such as acrylic acid and methacrylic acid; unsaturated dibasic acids; unsaturated dibasic anhydrides; a polymer of a nitro monomer, or a vinyl polymer of any of these vinyl monomers and a styrene monomer and/or an unsaturated carboxylate monomer; polyester; and an epoxy resin. A vinyl polymer, a maleic acid copolymer, a saturated polyester resin, an epoxy resin is more preferable, a vinyl polymer is still more preferable, and a copolymer containing styrene (or a derivative of styrene), acrylic acid (or methacrylic acid), and an acrylate (or a methacrylate) as copolymerization components is particularly preferable. In such case, the amount of remaining styrene is preferably 300 ppm or less because compatibility between the resin having polarity and the binder resin can be improved.

The resin having polarity preferably has a peak molecular weight Mp measured by GPC of 8,000 to 250,000, a weight-average molecular weight Mw of 8,000 to 260,000, and a ratio Mw/Mn of 1.05 to 5.00. In addition, the resin preferably has a glass transition temperature Tg determined by differential scanning calorimetry (DSC) of 80 to 120° C. In addition, the resin preferably has an acid value of 5 to 40 mgKOH/g.

The content of the resin having polarity is preferably 5 to 50 parts by mass, or more preferably 10 to 40 parts by mass with respect to 100 parts by mass of the polymerizable monomer or the binder resin.

Examples of the wax agent that can be used in the present invention include: petroleum waxes such as a paraffin wax, a microcrystalline wax, and petrolatum, and derivatives thereof; a montan wax and derivatives thereof; a hydrocarbon wax according to a Fischer-Tropsch method and derivatives thereof; polyolefin waxes such as a polyethylene wax and a polypropylene wax and derivatives thereof; and natural waxes such as a carnauba wax and a candelilla wax, and derivatives thereof. Derivatives include oxides, block copolymers with vinyl monomers, and graft modified products. Further, the following is exemplified: higher aliphatic alcohols; fatty acids such as staric acid, and palmitic acid; acid amide waxes; ester waxes; cured castor oils and derivatives thereof;

plant waxes; and animal waxes. Of those, an ester wax or a hydrocarbon wax is particularly preferable because the ester wax or the hydrocarbon wax is excellent in releasing performance. A wax containing 50 to 95 mass % of compounds identical to each other in total number of carbon atoms is more preferable because good developing performance can be easily obtained, and an effect of the present invention can be easily exerted.

The content of the wax is preferably 1 to 40 parts by mass, or more preferably 3 to 25 parts by mass with respect to 100 parts by mass of the binder resin. When the content of the wax falls within the above range, the wax can obtain moderate bleeding performance at the time of fixation, and the occurrence of the winding of a transfer material around a transferring member can be suppressed even when the temperature of the atmosphere surrounding the transfer material becomes high. Further, the extent to which the wax is exposed to the surface of the toner is small even when the toner receives a stress at the time of development or transfer, and the respective toner particles can obtain uniform charging performance.

Examples of a black colorant to be used include carbon black and a magnetic substance. In addition, those may be toned to each color by using the yellow/magenta/cyan colorant described below. A lot of dyes and carbon black particularly have polymerization-inhibiting performance, so attention is required when they are used.

Examples of the yellow colorant to be used include: compounds typified by a condensed azo compound, an isoindolinone compound, an anthraquinone compound, an azo metal complex, a methine compound, and an allylamide compound. Specific examples include C.I. Pigment Yellow 12, 13, 14, 15, 17, 62, 73, 74, 83, 93, 94, 95, 97, 109, 110, 111, 120, 128, 129, 138, 147, 150, 151, 154, 155, 168, 180, 185, and 214.

Examples of the magenta colorant to be used include: a condensed azo compound, a diketopyrrolopyrrole compound, anthraquinone, a quinacridone compound, a basic dye lake compound, a naphthol compound, a benzimidazolone compound, a thioindigo compound, a perylene compound. Specific examples include C.I. Pigment Red 2, 3, 5, 6, 7, 23, 48:2, 48:3, 48:4, 57:1, 81:1, 122, 146, 166, 169, 177, 184, 185, 202, 206, 220, 221, 238, 254, and 269, and C.I. Pigment Violet 19.

Examples of the cyan colorant to be used include: a copper phthalocyanine compound and a derivative of the compound; an anthraquinone compound; and a basic dye lake compound. Specific examples include C.I. Pigment Blue 1, 7, 15, 15:1, 15:2, 15:3, 15:4, 60, 62, and 66.

Each of those colorants can be used alone or as a mixture. Alternatively, each of the colorants can be used in the state of a solid solution. A colorant is selected in terms of a hue angle, chroma, lightness, light resistance, OHP transparency, and dispersing performance in the toner, and is added in a range of preferably 1 to 20 parts by mass with respect to 100 parts by mass of the polymerizable monomer or the binder resin.

Further, the toner of the present invention can be a magnetic toner containing a magnetic substance as a colorant. In this case, the magnetic substance can serve also as a colorant. Examples of the magnetic substance include: iron oxides such as magnetite, hematite, and ferrite; and metals such as iron, cobalt, and nickel, and metal alloys of those metals and a metal such as aluminum, cobalt, copper, lead, magnesium, tin, zinc, antimony, beryllium, bismuth, cadmium, calcium, manganese, selenium, titanium, tungsten, or vanadium, and mixtures thereof.

The magnetic substance is more preferably a surface-modified magnetic substance. When the magnetic toner is prepared by a polymerization method, the magnetic substance is preferably one subjected to a hydrophobic treatment with a surface modifier which is a substance that does not Inhibit polymerization. Examples of such surface modifier include a silane coupling agent and a titanium coupling agent.

The particles of the magnetic substance have a number average particle diameter of preferably 0.1 to 2 μm, or more preferably 0.1 to 0.5 μm. The content of the magnetic substance in the toner particles is preferably 20 to 200 parts by mass with respect to 100 parts by mass of the polymerizable monomer or the binder resin and is particularly preferably 40 to 150 parts by mass with respect to 100 parts by mass of the binder resin.

In addition, a charge control agent may be incorporated into the toner of the present invention for the purpose of stabilizing the charging characteristic of the toner. Known charge control agents can be used as a charge control agent, but when the charge control agent is produced by a direct polymerization method, a charge control agent having low polymerization-inhibiting performance and having substantially no product solubilized into an aqueous dispersion medium is particularly preferable. Specific examples of the compound to serve as a negative charge control agent include: metal compounds of aromatic carboxylic acids such as salicylic acid, alkyl salicylic acid, dialkyl salicylic acid, naphthoic acid, and dicarboxylic acid; metal salts or metal complexes of azo dyes or of azo pigments; boron compounds; silicon compounds; and calixarene. Further, specific examples of the compound to serve as a positive charge control agent include: quaternary ammonium salts; polymeric compounds having the quaternary ammonium salts at a side chains; guanidine compounds; nigrosin compounds; and imidazole compounds.

When any such charge control agent is internally added, the charge control agent is used in an amount in the range of preferably 0.1 to 10 parts by mass, or more preferably 0.1 to 5 parts by mass with respect to 100 parts by mass of the binder resin. In addition, when any such charge control agent is externally added, the charge control agent is used in an amount of preferably 0.005 to 1.0 part by mass, or more preferably 0.01 to 0.3 part by mass with respect to 100 parts by mass of the toner particles.

The toner of the present invention preferably contains a polymer or copolymer having a sulfonic group, a sulfonate group, or a sulfonic acid ester group as another charge control substance. The incorporation of any such polymer or copolymer into the toner uniformizes a toner coat amount along the longitudinal direction of the toner carrying member. As a result, an electrostatic latent image on a photosensitive member can be faithfully developed with the toner. In addition, an image having high uniformity in one page can be obtained. Further, the toner can be uniformly transferred onto even a transfer material having low smoothness.

In addition, the above polymer or copolymer contributes also to the stabilization of granulation in an aqueous medium when the toner is produced by a suspension polymerization method.

A monomer having a sulfonic group for producing the polymer is, for example, styrene sulfonic acid, 2-acrylamide-2-methylpropane sulfonic acid, 2-methacrylamide-2-methylpropane sulfonic acid, vinyl sulfonic acid, or methacryl sulfonic acid. The polymer containing a sulfonic group or the like to be used in the present invention may be a homopolymer of the monomer, or may be a copolymer of the monomer and any other monomer. The monomer that forms a copolymer with the monomer having a sulfonic group is, for example, a vinyl polymerizable monomer, and any one of the above-mentioned monofunctional and polyfunctional polymerizable monomers can be used.

In addition, the content of the polymer or copolymer having a sulfonic group or the like is preferably 0.01 to 5.0 parts by mass, more preferably 0.1 to 3.0 parts by mass, or particularly preferably 0.3 to 2.0 parts by mass with respect to 100 parts by mass of the polymerizable monomer or the binder resin. When the content of the polymer having a sulfonic group or the like falls within the above range, the toner can obtain sufficient charging performance and uniform transferring performance. Further, in a granulating step in an aqueous medium using a dispersion stabilizer having a positive component, the formation of an electric double layer is promoted, so a sharp distribution of the sizes of the toner particles can be obtained.

It should be noted that such polymer or copolymer is also a resin component having polarity. Accordingly, when the toner particles are produced by a suspension polymerization method, the polymer or copolymer is unevenly distributed on the outer layer portions of the toner particles, and, when cyclohexane insoluble matter in the THF soluble matter of the toner is separated, part of the polymer or copolymer is incorporated into the insoluble matter.

The toner of the present invention is preferably produced in an aqueous medium. A method of producing toner particles in an aqueous medium is, for example, any one of the following methods: an emulsion agglomeration method involving agglomerating an emulsion formed of an essential ingredient for toner in an aqueous medium; a suspension granulation method involving dissolving an essential ingredient for toner in an organic solvent, granulating the ingredient in an aqueous medium, and volatilizing the organic solvent after the granulation; a suspension polymerization method or emulsion polymerization method involving dispersing a polymerizable monomer in which an essential ingredient for toner is dissolved in an aqueous medium to granulate the polymerizable monomer, and polymerizing the polymerizable monomer after the granulation; a method involving providing toner with an outer layer by utilizing seed polymerization after suspension polymerization or emulsion polymerization; and a microcapsule method typified by interfacial polycondensation or submerged drying.

Of those, the suspension polymerization method is particularly preferable because a toner satisfying the specifications of the present invention can be easily obtained. In the suspension polymerization method, a wax and a colorant (and, furthermore, a polymerization initiator, a crosslinking agent, a charge control agent, a polar resin, and any other additive as required) are uniformly dissolved or dispersed in a polymerizable monomer so that a polymerizable monomer composition is prepared. After that, the polymerizable monomer composition is dispersed in an aqueous medium containing a dispersion stabilizer with an appropriate stirrer, and is then subjected to a polymerization reaction, whereby toner particles each having a desired particle diameter are obtained. In addition, the amount of dissolved oxygen in a reaction vessel where the polymerization reaction is performed is preferably controlled in order that the polymerization reaction may be efficiently advanced; the smaller the amount of dissolved oxygen, the higher the efficiency with which the polymerization reaction proceeds. As a result of the control, the production of a low-molecular weight component that adversely affects the developing performance and transferring performance of a toner to be obtained can be suppressed, whereby the toner can obtain high developing efficiency, high transfer efficiency, and excellent transfer uniformity. After the completion of the polymerization, the toner particles are filtrated, washed, and dried by known methods, and, as required, a flowability improver is mixed with, and caused to adhere to the surface of each of, the toner particles, whereby the toner of the present invention can be obtained.

When a toner is produced by the suspension polymerization method, the shapes of respective toner particles are substantially uniformized to a spherical shape, so a charge quantity distribution of the particles becomes relatively uniform, and a toner capable of satisfying a developing characteristic can be easily obtained. In addition, a toner which depends on an external additive to a small extent and maintains high transferring performance can be obtained.

Examples of the polymerizable monomer upon production of a toner by the suspension polymerization method include the monofunctional and polyfunctional polymerizable monomers described above.

A compound having two or more polymerizable double bonds is mainly used as the crosslinking agent. Examples of such compound include: aromatic divinyl compounds such as divinylbenzene and divinylnaphthalene; carboxylates each having two double bonds such as ethylene glycol diacrylate, ethylene glycol dimethacrylate, and 1,3-butanediol dimethacrylate; divinyl compounds such as divinylaniline, divinyl ether, divinyl sulfide, and divinyl sulfone; and compounds each having three or more vinyl groups. Those may be used alone or as a mixture. The monomer is added in an amount of preferably 0.001 to 15 part by mass with respect to 100 parts by mass of the polymerizable monomer.

An oil-soluble initiator and/or a water-soluble initiator are each/is used as the polymerization initiator. A preferable polymerization initiator is such that the time period for which the molecules of the initiator reduce in half at a reaction temperature at the time of the polymerization reaction is 0.5 to 30 hours. In addition, when the polymerization reaction is performed in a state where the initiator is added in an amount of 0.5 to 20 parts by mass with respect to 100 parts by mass of the polymerizable monomer, a polymer having a local maximum in the molecular weight range of 10,000 to 100,000 is typically obtained, so a toner having an appropriate strength and an appropriate melting characteristic can be obtained.

Examples of the polymerization initiator include: azo or diazo polymerization initiators such as 2,2'-azobis-(2,4-dimethylvaleronitrile), 2,2'-azobisisobutyronitrile, 1,1'-azobis (cyclohexane-1-carbonitrile), 2,2'-azobis-4-methoxy-2,4-dimethylvaleronitrile, and azobisisobutyronitrile; and the peroxide polymerization initiators such as benzoylperoxide, t-butylperoxy 2-ethylhexanoate, t-butylperoxypivalate, t-butylperoxy isobutylate, t-butylperoxyneodecanoate, methylethylketone peroxide, diisopropylperoxy carbonate, cumenehydroperoxide, 2,4-dichlorobenzoylperoxide, and lauroylperoxide. Particularly preferred is a polymerization initiator which generates the following ether compounds upon decomposition during the polymerization reaction.

In addition, the toner of the present invention preferably contains a compound represented by the following structural formula (1) or (2).

[Chem 1]

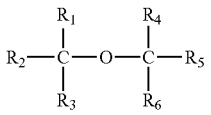

(1)

[Chem 2]

-continued (2)

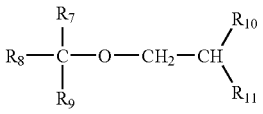

(In the formulae, $R_1$ to $R_{11}$ each represent an alkyl group having 1 to 6 carbon atoms, or more preferably an alkyl group having 1 to 4 carbon atoms.)

When the above compound is incorporated into the toner, the compound is present while being dispersed in a nearly uniform state because the compound is excellent in compatibility with the binder resin. In addition, the oxygen atom of the compound delocalizes negative charge generated in the toner when the compound is present while being dispersed because the oxygen atom is an element having a high electronegativity. Accordingly, the incorporation of an ether compound can stabilize the negative charge of the toner. The effect of incorporating the ether compound becomes particularly significant when the toner of the present invention is a toner that can be negatively charged by triboelectric charging. In addition, the ether compound has a suppressing effect on charge up when the toner can be positively charged by triboelectric charging.

In addition, the ether compound is of a bulky structure because the compound has a tertiary carbon atom. The compound is hardly affected by water, and the leak of charge from the compound is suppressed because functional groups bonded to the tertiary carbon atom each function as steric hindrance. However, when the carbon atom bonded to the oxygen atom rotates, any functional group which can be steric hindrance can also move. In addition, a water molecule involved in the leak of triboelectric charge from the compound is a small molecule, so none of the functional groups can be complete steric hindrance. As a result, the functional groups bonded to the tertiary carbon atom each function as moderate steric hindrance to block water molecules moderately. As a result, the toner containing the ether compound can obtain good charging performance even under a high-humidity environment or low-humidity environment. In particular, when the polar resin and the ether compound are used in combination, the ether compound can exert a stabilizing effect on the charge of the toner even in the resin of the outer layer, whereby the charging performance of the toner can be improved in an additionally favorable fashion. Therefore, the following excellent effects are obtained: the action and effect of the present invention are secured, specifically, toner coat uniformity on a toner carrying member and transfer efficiency are maintained at high levels, the transfer uniformity of the toner in one page is obtained, and the toner can be easily transferred onto a transfer material having low smoothness in a uniform fashion.

The toner contains the ether compound at a content in the range of preferably 5 to 1,000 ppm, more preferably 10 to 800 ppm, or still more preferably 10 to 500 ppm. The ether compound may be a mixture with an ether compound having another structure as long as the mixture is mainly formed of a compound having the above structure. At that time, the content is defined as the total sum of the amounts of ether compounds in the toner. When the content of the ether compound in the toner falls within the above range, a good triboelectric charge quantity is obtained, and the toner is uniformly charged. In addition, toner coat uniformity on a toner carrying member and transfer efficiency are maintained at high levels, the transfer uniformity of the toner in one page is obtained, and the toner can be uniformly transferred onto even a transfer material having low smoothness.

The ether compound, which may be added and incorporated as formulation at the time of the production of the toner particles, can be produced from a decomposition product of the polymerization initiator in a polymerization vessel.

Examples of the structure of the ether compound include the following structures.

[Chem 3]

Ether Compound 1

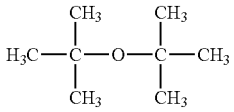

[Chem 4]

Ether Compound 2

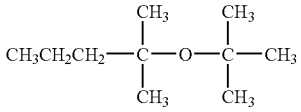

[Chem 5]

Ether Compound 3

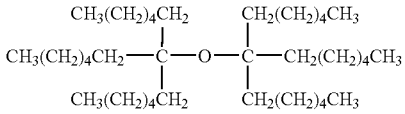

[Chem 6]

Ether Compound 4

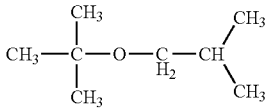

When the toner is produced by a suspension polymerization method, a known chain transfer agent, polymerization inhibitor, or the like can be further added and used in order that the degree of polymerization of the polymerizable monomer may be controlled.

In addition, when a polymerization method toner is produced by adding toluene or xylene into a monomer, the solubility of a resin having polarity in the monomer is improved, and stability upon formation of the outer layer of the toner by the precipitation of the resin is improved, so the ease with which the effect of the present invention is exerted is improved; it should be noted that the mechanism via which the solubility and the stability are improved is not clear. Toluene or xylene is added in an amount of preferably 0.5 to 5.0 parts by mass with respect to 100 parts by mass of the monomer.

A dispersion stabilizer may be added to the aqueous medium. As an inorganic compound that can be used in the dispersion stabilizer, there are exemplified calcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. As an organic compound, there are exemplified polyvinyl alcohol, gelatin, methylcellulose, methylhydroxypropylcellulose, ethylcellulose, sodium salts of carboxymethylcellulose, polyacrylic acid and its salts, and starch. The dispersion stabilizer is used in an amount of preferably 0.2 to 2.0 parts by mass with respect to 100 parts by mass of a polymerizable monomer.

In addition, 0.001 to 0.1 part by mass of surfactant may be used to disperse those dispersion stabilizer finely. The surfactant is also used to promote the expected function of the dispersion stabilizer. Specific examples of the surfactant include sodium dodecyl benzene sulfate, sodium tetradecyl sulfate, sodium pentadecyl sulfate, sodium octyl sulfate, sodium oleate, sodium laurate, potassium stearate, and calcium oleate.

When an inorganic compound is used as the dispersion stabilizer, a commercially available compound may be used as it is, or the inorganic compound may be produced in an aqueous medium and used in order that additionally fine particles may be obtained. Mixing an aqueous solution of sodium phosphate and an aqueous solution of calcium chloride under high-speed stirring suffices for the preparation of, for example, calcium phosphate.

Further, a flowability improver may be externally added to each of the toner particles in the toner of the present invention for improving the flowability of each of the toner particles. Examples of the flowability improver include: fluorine resin powders such as a vinylidene fluoride fine powder and a polytetrafluoroethylene fine powder; metal salts of aliphatic acids such as zinc stearate, calcium stearate, and lead stearate; metal oxides such as a titanium oxide powder, an aluminum oxide powder, and a zinc oxide powder, or powders obtained by subjecting the metal oxides to a hydrophobic treatment; and silica fine powders such as wet process silica and dry process silica. In addition, the surface of any one of those fine powders is more preferably treated with a treatment agent such as a silane coupling agent, a titanium coupling agent, or silicone oil. The flowability improver is used in an amount of preferably 0.01 to 5 parts by mass with respect to 100 parts by mass of the toner particles.

Next, an example of an image-forming method involving the use of the toner of the present invention will be described with reference to FIGS. 3 and 4.

Figure 4:
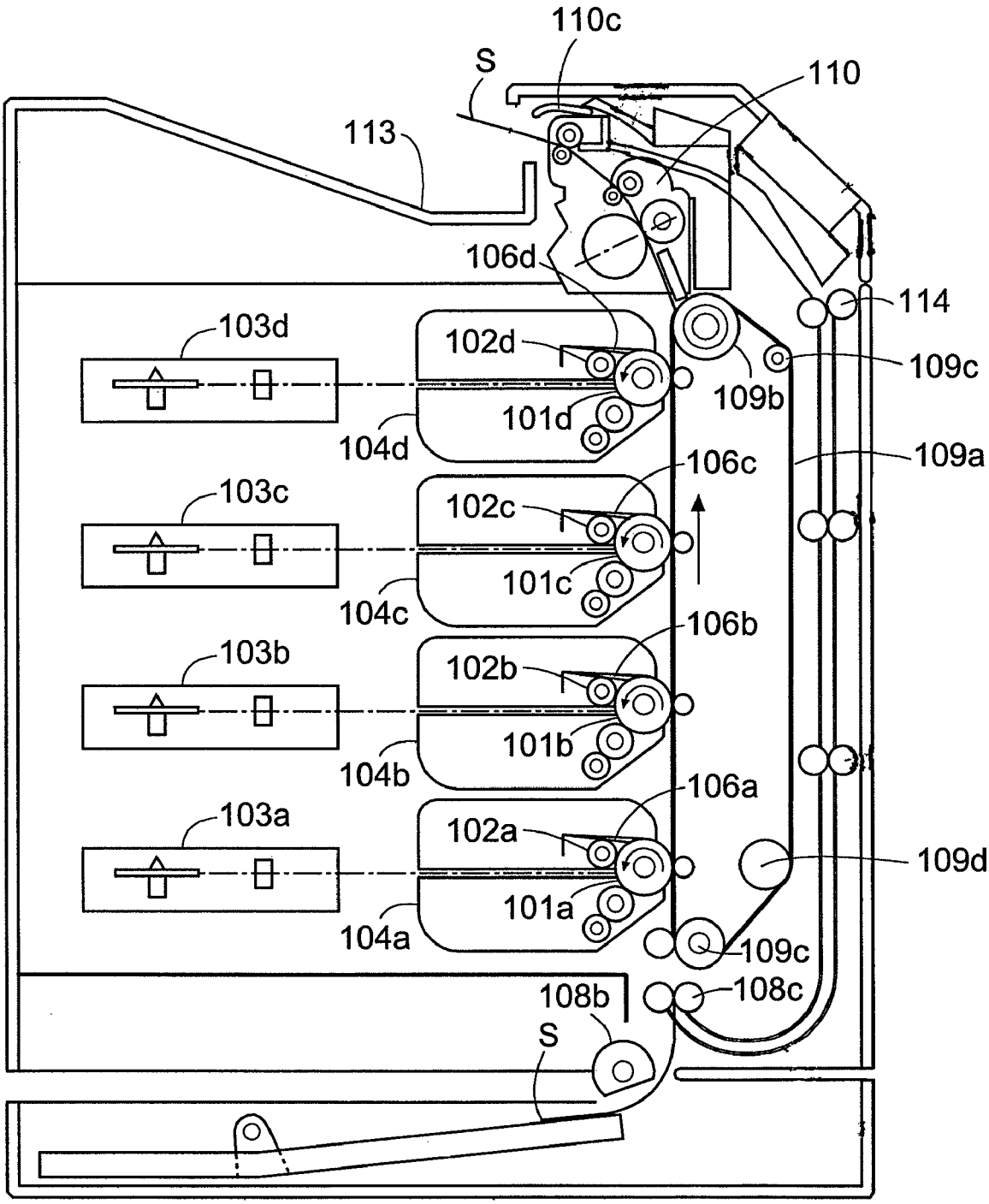
FIG. 4 is a view showing the constitution of an image-forming apparatus using a contact, one-component developing system.

FIG. 4 shows the constitution of an image-forming apparatus (contact, one-component developing system) used in the examples of the present invention. The image-forming apparatus is a tandem color laser beam printer (color LBP) (LBP-2510, manufactured by Canon Inc.).

In FIG. 4, reference symbols 101 (101*a* to 101*d*) represent drum type electrophotographic photosensitive members (hereinafter referred to as "photosensitive drums") as electrostatic latent image bearing members each of which rotates in the direction indicated by an arrow shown in the figure (counterclockwise direction) at a predetermined process speed. The photosensitive drums 101*a*, 101*b*, 101*c*, and 101*d* are responsible for the yellow (Y) component, magenta (M) component, cyan (C) component, and black (Bk) component of a color image, respectively. The photosensitive drums 101*a* to 101*d* are each rotated by an unshown drum motor (DC servo motor). The respective photosensitive drums 101*a* to 101*d* may be provided with driving sources independent of one another. The rotation of each of the drum motors is controlled by an unshown digital signal processor (DSP), and any other control is performed by an unshown CPU.

In addition, an electrostatic adsorption transport belt 109*a* is tensioned around a driver roller 109*b*, fixed rollers 109*c* and 109*e*, and a tension roller 109*d*, and is rotated in the direction indicated by an arrow shown in the figure by the driver roller 109*b* to adsorb and transport a transfer material S (recording medium S). Hereinafter, description will be given by taking a yellow color (Y) out of the four colors as an example.

The photosensitive drum 101*a* is uniformly subjected to a primary charging treatment by primary charging means 102*a* during its rotation so as to have predetermined polarity and a predetermined potential. Then, the photosensitive drum 101*a* is exposed to light by laser beam exposing means (hereinafter referred to as "scanner") 103*a*, whereby an electrostatic latent image is formed on the photosensitive drum 101*a*.

Next, the electrostatic latent image is developed by a developing portion 104*a*, whereby a toner image is formed on the photosensitive drum 101*a*. Similar steps are performed for the other three colors (magenta (M), cyan (C), and black (Bk)).

Next, four color toner images are sequentially transferred onto the recording medium S, which is transported at a timing adjusted by a sheet feeding roller 108*b* and a resist roller 108*c*, at a nip portion between each of the photosensitive drums 101*a* to 101*d* and the electrostatic adsorption transport belt 109*a*.

In addition, a residual adhering substance such as transfer residual toner is removed from the photosensitive drums 101*a* to 101*d* by cleaning means 106*a*, 106*b*, 106*c*, and 106*d* after the toner images have been transferred onto the recording medium S.

The recording medium S onto which the toner images have been transferred from the four photosensitive drums 101*a* to 101*d* is separated from the surface of the electrostatic adsorption transport belt 109*a* at the driver roller 109*b* portion so as to be fed into a fixing unit 110. Then, the toner images are fixed on the recording medium S in the fixing unit 110. After that, the medium is discharged to a discharge tray 113 by a discharge roller 110*c*.

Figure 3:
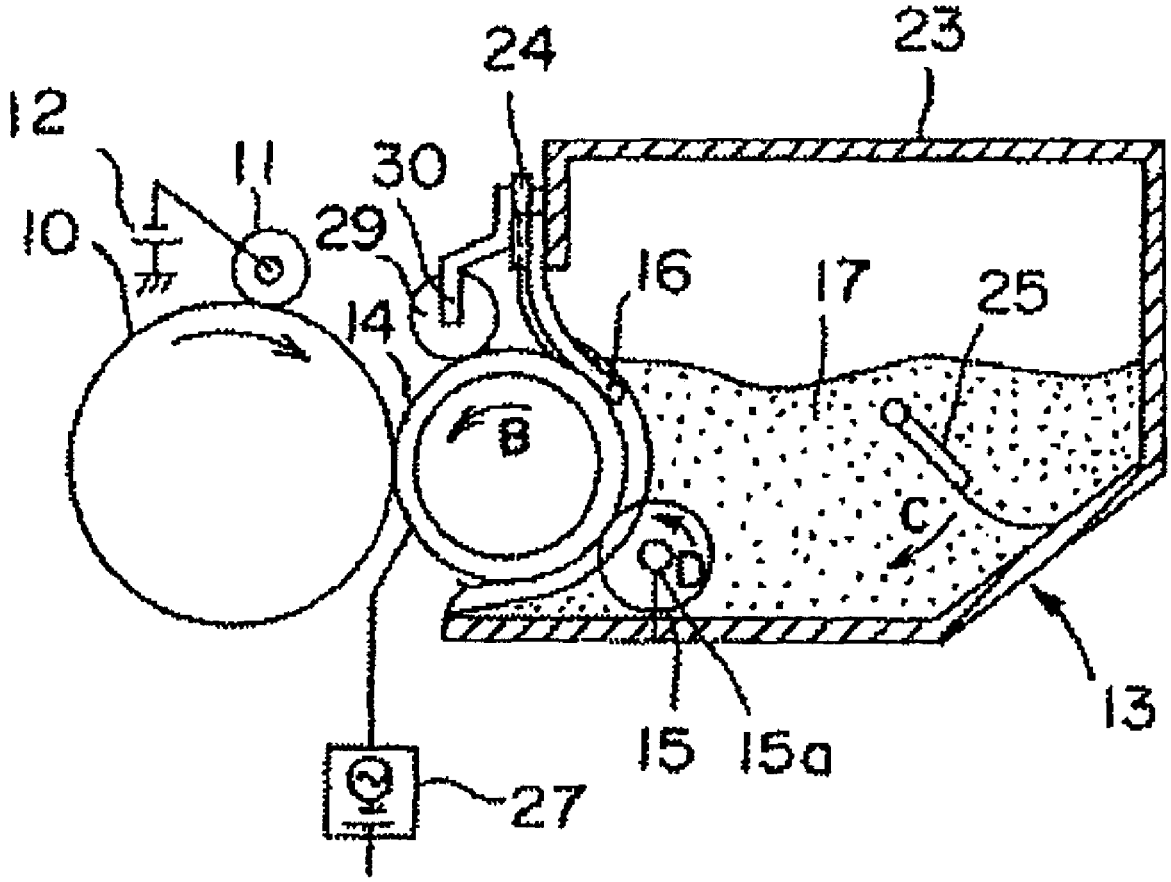
FIG. 3 is an enlarged view of a developing portion of an electrophotographic apparatus.

Next, a specific example of an image-forming method in a non-magnetic, one-component, contact developing system will be described with reference to an enlarged view of a developing portion (FIG. 3). In FIG. 3, a developing unit 13 includes: a developer container 23 storing a non-magnetic toner 17 as a one-component developer; an electrostatic latent image bearing member (photosensitive drum) 10 positioned at an opening extending in the longitudinal direction in the developer container 23; and a toner carrying member 14 placed so as to face the electrostatic latent image bearing member 10. The toner 17 is transported toward the toner carrying member by a toner transport member 25.

In addition, the developing unit 13 develops an electrostatic latent image on the electrostatic latent image bearing member 10 to form a toner image. An electrostatic latent image bearing member contact charging member 11 contacts the electrostatic latent image bearing member 10. The bias of the electrostatic latent image bearing member contact charging member 11 is applied by a power supply 12.

The toner carrying member 14 is installed laterally while substantially the right half of its circumferential surface shown in the figure is exposed to the inside of the developer container 23 and substantially the left half of its circumferential surface shown in the figure is exposed to the outside of the developer container 23 at the opening. The surface exposed to the outside of the developer container 23 contacts the electrostatic latent image bearing member 10 positioned on the left side of the developing unit 13 in FIG. 3 as shown in the figure.

The circumferential speed of the electrostatic latent image bearing member 10 is 50 to 170 mm/s, and the toner carrying member 14 rotates in the direction indicated by an arrow B at a circumferential speed one time to twice as high as that of the electrostatic latent image bearing member 10.

A control member 16 is supported by a control member support plate 24 above the toner carrying member 14. The control member uses a metal plate formed of, for example, SUS, a rubber material such as urethane or silicone, or a metal thin plate formed of SUS having rubber elasticity or phosphor bronze as a substrate. A rubber material is bonded to the side of the surface of the control member contacting the toner carrying member 14.

The control member 16 is provided so that the vicinity of its edge on a free edge side contacts the outer circumferential surface of the toner carrying member 14 by surface contact. The direction in which the vicinity contacts the outer circumferential surface is a counter direction in which the tip side is positioned on the upstream side relative to the contact portion of the direction in which the toner carrying member 14 rotates. An example of the control member 16 is a constitution in which plate-like urethane rubber having a thickness of 1.0 mm is bonded to the control member support plate 24 and the contact pressure (linear pressure) at which the control member contacts the toner carrying member 14 is appropriately set. The contact pressure is preferably 20 to 300 N/m. The contact pressure is measured as follows: three metal thin plates each having a known coefficient of friction are inserted into the portion where the control member and the toner carrying member contact each other, and the value of a force needed for pulling the center plate with a spring balance is converted into the contact pressure. A rubber material is preferably bonded to the surface of the control member 16 contacting the toner carrying member in terms of adhesiveness with toner; the melt adhesion and sticking of the toner to the control member upon long-term use of the toner can be suppressed. In addition, the control member 16 can contact the toner carrying member 14 in an edge contact fashion as described below: an edge of the control member is brought into contact with the toner carrying member. In the case of the edge contact, the contact angle of the control member 16 relative to the tangent of the toner carrying member at the point where the control member contacts the toner carrying member is more preferably set to 40° or less in terms of the control of the thickness of a toner layer.

A toner feeding roller 15 (reference symbol 15*a* represents the axis of the toner feeding roller) is brought into contact with the upstream side of the direction in which the toner carrying member 14 rotates relative to the portion where the control member 16 contacts the surface of the toner carrying member 14, and the roller is rotatably supported. An effective width at which the toner feeding roller 15 contacts the toner carrying member 14 is 1 to 8 mm, and the toner carrying member 14 is preferably provided with a relative velocity at the portion where the toner feeding roller and the toner carrying member contact each other.

A charging roller 29 for a toner carrying member is an elastic body such as an NBR or a silicone rubber, and is attached to a suppressing member 30. In addition, the load under which the charging roller 29 for a toner carrying member is brought into contact with the toner carrying member 14 by the suppressing member 30 is set to 0.49 to 4.9 N. A toner layer on the toner carrying member 14 is subjected to closest packing, and the upper portion of the toner carrying member is uniformly coated with the toner layer by the contact of the charging roller 29 for a toner carrying member. A longitudinal positional relationship between the control member 16 and the charging roller 29 for a toner carrying member is preferably such that the charging roller 29 for a toner carrying member is placed so as to be capable of covering the entire region on the toner carrying member 14 in contact with the control member 16 with reliability.

In addition, it is an absolute necessity for the charging roller 29 for a toner carrying member to be driven by the toner carrying member 14 or to rotate at the same circumferential speed as that of the member. The presence of a difference in circumferential speed between the charging roller 29 for a toner carrying member and the toner carrying member 14 is not preferable because the toner carrying member is non-uniformly coated with the toner, and unevenness arises on an image formed with the toner.

The bias of the charging roller 29 for a toner carrying member is applied by a power supply 27 between both the toner carrying member 14 and the electrostatic latent image bearing member 10 as a DC voltage (reference symbol 27 in FIG. 3), and the non-magnetic toner 17 on the toner carrying member 14 is provided with charge from the charging roller 29 for a toner carrying member by discharge.

The bias of the charging roller 29 for a toner carrying member is a bias equal to or higher than a breakdown voltage identical in polarity to the non-magnetic toner, and is set so that a potential difference of 1,000 to 2,000 V arises between the roller and the toner carrying member 14.

After having been provided with charge by the charging roller 29 for a toner carrying member, the toner layer formed into a thin layer on the toner carrying member 14 is uniformly transported to the developing portion as a portion facing the electrostatic latent image bearing member 10.

In the developing portion, the toner layer formed into a thin layer on the toner carrying member 14 develops the electrostatic latent image on the electrostatic latent image bearing member 10 with the aid of the DC bias applied by the power supply 27 shown in FIG. 3 between both the toner carrying member 14 and the electrostatic latent image bearing member 10 so as to form a toner image.

Hereinafter, methods of measuring various physical property values will be described.

(1) Peak Molecular Weight (MpA) of THF Soluble Matter of Toner Measured by Gel Permeation Chromatography (GPC)

First, toner as a target of measurement and THF were mixed so that the concentration of the toner in the mixture was 5 mg/ml. Then, the mixture was left to stand at room temperature for 5 hours. After that, the mixture was sufficiently shaken so that THF and the sample were mixed well with each other (until the coalesced body of the sample disappeared). Then, the mixture was left at rest at room temperature for an additional 24 hours. After that, the mixture was passed through a sample treatment filter (a MAISHORI DISK H-25-2 manufactured by TOSOH CORPORATION or an EKICRODISC 25CR manufactured by German Science Japan Co., Ltd.), and was regarded as a sample for GPC.

The molecular weight distribution of the prepared sample was measured with a GPC measuring apparatus (HLC-8120 GPC: manufactured by TOSOH CORPORATION) in accordance with the operation manual of the apparatus under the following measurement conditions, and the peak molecular weight of the sample was determined.

(Measurement Conditions)

| | |
|---|---|
| Apparatus: | High speed GPC "HLC-8120 GPC" (manufactured by TOSOH CORPORATION) |
| Column: | A series of seven columns SHODEX KF-801, 802, 803, 804, 805, 806, and 807 (manufactured by Showa Denko K.K.) |
| Eluent: | THF |
| Flow rate: | 1.0 ml/min |
| Oven temperature: | 40.0° C. |
| Amount in which sample is injected: | 0.10 ml |

In addition, upon calculation of the molecular weight of the sample, a molecular weight calibration curve prepared with a standard polystyrene resin (TSK Standard Polystyrene F-850, F-450, F-288, F-128, F-80, F-40, F-20, F-10, F-4, F-2, F-1, A-5000, A-2500, A-1000, or A-500 manufactured by TOSOH CORPORATION) was used as a calibration curve.

(2) Content of Cyclohexane Insoluble Matter in THF Soluble Matter of Toner

Toner as a target of measurement and THF were mixed so that the concentration of the toner in the mixture was 450 mg/ml. Then, the mixture was sufficiently shaken at room temperature for 10 hours so that THF and the sample were mixed well with each other until the coalesced body of the sample disappeared. Further, the mixture was left at rest for 7 days. After that, the resultant solution was centrifuged with a refrigerated high-speed centrifuge (such as an H-9R (manufactured by KOKUSAN Co. Ltd.)) at 15,000 rpm for 60 minutes in an environment at 10° C. so that the solution was separated into a supernatant and a precipitate. Then, the supernatant was collected. Further, the supernatant was reduced by 50% while being bubbled with a nitrogen gas, whereby a condensate was prepared. After that, 5 ml of the condensate were charged into 100 ml of cyclohexane so that insoluble matter was produced.

After that, the liquid in which the insoluble matter had been produced was centrifuged with a refrigerated high-speed centrifuge (such as an H-9R (manufactured by KOKUSAN Co. Ltd.)) at 15,000 rpm for 60 minutes in an environment at 10° C. so that the liquid was separated into a supernatant and a precipitate (cyclohexane insoluble matter). Then, the supernatant was removed. The precipitate after the removal was left at rest at room temperature for 24 hours. After that, the precipitate was subjected to desolvation in a vacuum dryer (40° C.) for 24 hours, and a component serving as the cyclohexane insoluble matter was collected. The content of the cyclohexane insoluble matter in the THF soluble matter of the toner can be determined from the following equation.

Content (mass %) of cyclohexane insoluble matter in THF soluble matter with respect to toner={(cyclohexane insoluble matter in THF soluble matter)/mass of toner}×100

(3) Peak Molecular Weight (MpB) of Cyclohexane Insoluble Matter in THF Soluble Matter of Toner Measured by Gel Permeation Chromatography (GPC)

Cyclohexane insoluble matter in the THF soluble matter of toner was collected as described above. Measurement was performed by using the cyclohexane insoluble matter as a measurement sample in the same manner as in the determination of the peak molecular weight (MpA) of the THF soluble matter of the toner.

(4) Viscosity at 100° C. Measured by Flow Tester Heating Method

Measurement was performed with a Flow Tester CFT-500D (manufactured by Shimadzu Corporation) in accordance with the operation manual of the apparatus under the following conditions. It should be noted that the viscosities of toner at temperatures of 50° C. to 200° C. were measured, and the viscosity of the toner at a temperature of 100° C. was determined.

| | |
|---|---|
| Sample: | About 1.0 g of the toner was weighed, and was molded into a sample with a pressure molder. |
| Die hole diameter: | 0.5 mm |
| Die length: | 1.0 mm |
| Cylinder pressure: | $9.807 \times 10^5$ (Pa) |
| Measurement mode: | Temperature increase method |
| Rate of temperature increase: | 4.0° C./min |

(5) Glass Transition Temperature (TgA) of Toner, Peak Temperature (P1) of Highest Endothermic Peak of Toner, and Glass Transition Temperature (TgB) of Cyclohexane Insoluble Matter Measurement was performed by using a DSC-7 (manufactured by PerkinElmer, Inc.), a DSC2920 (manufactured by TA Instruments Japan Inc.), or the like as a differential scanning calorimeter (DSC measuring apparatus) in conformance with ASTM D3418-82 as described below. 2 to 5 mg, or preferably 3 mg, of a measurement sample were precisely weighed. The sample was loaded into an aluminum pan, and an empty aluminum pan was used for reference. After the sample had been kept in equilibrium at 20° C. for 5 minutes, the measurement was performed in the measurement temperature range of 20 to 140° C. at a rate of temperature increase of 1° C./min while a modulation of 1.0° C./min was applied. In the present invention, a glass transition temperature was determined by a middle point method. In addition, when multiple endothermic peaks were present, one having the highest height from a baseline in a region above the endothermic peaks was defined as the highest endothermic peak.

(6) Acid Value of Cyclohexane Insoluble Matter in THF Soluble Matter

The acid value of cyclohexane insoluble matter was determined from the following equation.

(Preparation of Sample)

1.0 g of a sample was weighed in a 200-ml beaker, and was dissolved in 120 ml of toluene while toluene was stirred with a stirrer. Further, 30 ml of ethanol were added to the solution.

(Apparatus)

For example, a potentiometric automatic titration apparatus AT-400WIN (manufactured by Kyoto Denshi) was used as an apparatus. The setting of the apparatus was intended for a sample to be dissolved in an organic solvent. A glass electrode and a relation electrode used were each adaptable to the organic solvent. For example, a product code #100-H112 was used as a pH glass electrode, and a product code #100-R115 was used as a cork relation electrode. Attention was paid so that the tip of each of both the electrodes never dried. In addition, a 3.3-mol/l KCl solution was used as an internal liquid, and the apparatus was checked for whether the apparatus was filled with the internal liquid so that the liquid reached the internal liquid replenishment port of the apparatus.

(Procedure)

The prepared sample was set in the automatic sampler of the apparatus, and the electrodes were immersed in a solution of the sample. Next, a titrant (0.1-mol/l solution of KOH in ethanol, f=1.009)) was set above the solution of the sample, and was dropped in amounts of 0.05 ml each by automatic intermittent titration. The acid value was calculated from the obtained results on the basis of the following equation.

Acid value (mgKOH/g)=[(end point of sample−end point of blank)×$f$×56×0.1]/mass of sample (7) Average Circularity of Toner The average circularity of toner was calculated with a flow-type particle image analyzer "FPIA-3000 model" (manufactured by SYSMEX CORPORATION) in accordance with the operation manual of the analyzer under the following conditions. The measurement principle of the flow-type particle image analyzer "FPIA-3000 model" (manufactured by SYSMEX CORPORATION) is as follows: a flowing particle is photographed as a static image, and the image is analyzed. A sample loaded into a sample chamber is fed into a flat sheath flow cell with a sample sucking syringe. The sample fed into the flat sheath flow cell is sandwiched between sheath liquids to form a flat flow. The sample passing through the inside of the flat sheath flow cell is irradiated with stroboscopic light at an interval of 1/60 second, whereby flowing particles can be photographed as a static image. In addition, the particles are photographed in focus because the flow of the particles is flat. A particle image is photographed with a CCD camera, and the photographed image is subjected to image processing at an image processing resolution of 512×512 (0.37 μm×0.37 μm per pixel) so that the edge of each particle image is sampled. Then, the projected area, perimeter, and the like of each particle image are measured. An image signal is subjected to A/D conversion in an image processing portion and captured as image data, and stored image data is subjected to image processing for judging whether a particle is present. Next, an edge enhancing treatment as a pretreatment for appropriately sampling the edge of each particle image is performed.

Next, image data is binarized at a certain appropriate threshold level.

When image data is binarized at a certain appropriate threshold level, each particle image becomes such binarized image as shown in FIG. 1. Next, judgment as to whether each binarized particle image is an edge point (edge pixel representing an edge) is made, and information about the direction in which an edge point adjacent to the edge point of interest is present, that is, a chain code is prepared.

Next, the projected area S and perimeter L of each particle image are determined. The circle-equivalent diameter and circularity of a particle in each image are determined by using the area S and the perimeter L described above. The term "circle-equivalent diameter" refers to the diameter of a circle having the same area as that of the projected area of a particle image. The circularity (C) is defined as a value obtained by dividing the perimeter of a circle determined from the circle-equivalent diameter by the perimeter of a particle projected image, and is calculated from the following equation.

$$C=2\times(\pi S)^{1/2}/L$$

When a particle image is of a circular shape, the circularity of the particle in the image becomes 1. As the degree of surface unevenness in the outer periphery of the particle image increases, the circularity shows a reduced value.

After the circularities of the respective particles have been calculated, a circularity range of 0.2 to 1.0 is divided into 800 sections, the calculated circularities are allotted to the 800 sections, and the average circularity of the particles is calculated by using the central value of each divisional section and the number of measured particles.

The average circularity C is calculated from the following equation when a circularity (central value) at a divisional section i in the grain size distribution of the particles is represented by ci and the number of measured particles is represented by m.

$$\text{Average circularity } C=\sum_{i=1}^{m} ci/m \quad \text{[Num 1]}$$

A specific measurement method is as follows. 10 ml of ion-exchanged water from which an impurity solid and the like have been removed in advance are prepared in a vessel. A surfactant (preferably alkylbenzene sulfonate) is added as a dispersant to the ion-exchanged water, and then 0.02 g of measurement sample is added to and uniformly dispersed into the mixture. The resultant mixture is subjected to a dispersion treatment for 5 minutes by using as dispersion means an ultrasonic disperser "UH-50" (manufactured by SMT Co., Ltd.) provided with a titanium alloy tip having a diameter of 5 mm as an oscillator to prepare a dispersion for measurement. At that time, the dispersion is appropriately cooled in order that the temperature of the dispersion may not be 40° C. or higher. The concentration of the dispersion is adjusted again in such a manner that the toner particle concentration at the time of measurement is in the range of 3,000 to 10,000 particles/μl, and 1,000 or more particles are measured by using the flow-type particle image analyzer.

(8) Weight-Average Particle Diameter (D4) and Number Average Particle Diameter (D1) of Toner A precision grain size distribution measuring apparatus based on a pore electrical resistance method provided with a 100-μm aperture tube "COULTER COUNTER MULTISIZER 3" (registered trademark, manufactured by Beckman Coulter, Inc.) was used as a measuring apparatus. Dedicated software included with the apparatus "BECKMAN COULTER MULTISIZER 3 Version 3.51" (manufactured by Beckman Coulter, Inc.) was used for setting measurement conditions and analyzing measurement data. It should be noted that the measurement was performed while the number of effective measurement channels was set to 25,000. An electrolyte solution prepared by dissolving reagent grade sodium chloride in ion-exchanged water to have a concentration of about 1 mass %, for example, an "ISOTON II" (manufactured by Beckman Coulter, Inc.) was used as an electrolyte solution to be used in the measurement.

It should be noted that the dedicated software was set as described below prior to the measurement and the analysis. In the "change standard measurement method (SOM)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc.) is set as a Kd value. A threshold and a noise level are automatically set by pressing a "threshold/noise level measurement" button. In addition, a current is set to 1,600 μA, a gain is set to 2, and an electrolyte solution is set to an ISOTON II, and a check mark is placed in a check box as to whether the aperture tube is flushed after the measurement. In the "setting for conversion from pulse to particle diameter" screen of the dedicated software, a bin interval is set to a logarithmic particle diameter, the number of particle diameter bins is set to 256, and a particle diameter range is set to the range of 2 μm to 60 μm.

A specific measurement method is as described below.

(i) About 200 ml of the electrolyte solution were charged into a 250-ml round-bottom beaker formed of glass dedicated for the MULTISIZER 3. The beaker was set in a sample stand, and the electrolyte solution in the beaker was stirred with a stirrer rod at 24 rotations/sec in a counterclockwise direction. Then, dirt and bubbles in the aperture tube were removed by the "aperture flush" function of the dedicated software.

(ii) About 30 ml of the electrolyte solution were charged into a 100-ml flat-bottom beaker formed of glass. About 0.3 ml of a diluted solution prepared by diluting a "CONTAMINON N" (a 10-mass % aqueous solution of a neutral detergent for washing a precision measuring device formed of a nonionic surfactant, an anionic surfactant, and an organic builder and having a pH of 7, manufactured by Wako Pure Chemical Industries, Ltd.) with ion-exchanged water by about 3-fold by mass was added as a dispersant to the electrolyte solution.

(iii) An ultrasonic dispersing unit "ULTRASONIC DISPERSION SYSTEM TETRA 150" (manufactured by Nikkaki Bios Co., Ltd.) in which two oscillators each having an oscillatory frequency of 50 kHz were built so as to be out of phase by 180° and which had an electrical output of 120 W was prepared. A predetermined amount of ion-exchanged water was charged into the water tank of the ultrasonic dispersing unit. About 2 ml of the CONTAMINON N were charged into the water tank.

(iv) The beaker in the section (ii) was set in the beaker fixing hole of the ultrasonic dispersing unit, and the ultrasonic dispersing unit was operated. Then, the height position of the beaker was adjusted in order that the liquid level of the electrolyte solution in the beaker might resonate with an ultrasonic wave from the ultrasonic dispersing unit to the fullest extent possible.

(v) About 10 mg of toner were gradually added to and dispersed in the electrolyte solution in the beaker in the section (iv) in a state where the electrolyte solution was irradiated with the ultrasonic wave. Then, the ultrasonic dispersion treatment was continued for an additional 60 seconds. It should be noted that the temperature of water in the water tank was appropriately adjusted so as to be 10° C. or higher and 40° C. or lower upon ultrasonic dispersion.

(vi) The electrolyte solution in the section (v) in which the toner had been dispersed was dropped with a pipette to the round-bottom beaker in the section (i) placed in the sample stand, and the concentration of the toner to be measured was adjusted to about 5%. Then, measurement was performed until the particle diameters of 50,000 particles were measured.

(vii) The measurement data was analyzed with the dedicated software included with the apparatus, and the weight-average particle diameter (D4) and number average particle diameter (D1) of the toner were calculated. It should be noted that an "average diameter" on the "analysis/volume statistics (arithmetic average)" screen of the dedicated software when the dedicated software was set to show a graph in a vol % unit was the weight-average particle diameter (D4), and an "average diameter" on the "analysis/number statistics (arithmetic average)" screen of the dedicated software when the dedicated software was set to show a graph in a number % unit was the number average particle diameter (D1).

(9) Ratio of Particles Each Having Particle Diameter Equal to or Less than One Third of Weight-Average Particle Diameter (D4) to Total Number of Particles of Toner (Small-Particle Ratio)

A ratio of the number of particles each having a particle diameter equal to or less than one third of the weight-average particle diameter (D4) of the toner determined as described above to the total number of the particles of the toner was calculated. The respective particle numbers were determined by utilizing a circle-equivalent diameter distribution obtained upon measurement of the average circularity of the toner. It should be noted that, as shown in Table 1, the circle-equivalent diameter distribution can be obtained in the form of data obtained by dividing a particle diameter range of 0.06 to 400 μm into 226 channels (one octave is divided into 30 channels).

TABLE 1

| Particle diameter range (μm) |
|---|
| 0.60~0.61 |
| 0.61~0.63 |
| 0.63~0.65 |
| 0.65~0.67 |

TABLE 1-continued

| Particle diameter range (μm) |
|---|
| 0.67~0.69 |
| 0.69~0.71 |
| 0.71~0.73 |
| 0.73~0.75 |
| 0.75~0.77 |
| 0.77~0.80 |
| 0.80~0.82 |
| 0.82~0.84 |
| 0.84~0.87 |
| 0.87~0.89 |
| 0.89~0.92 |
| 0.92~0.95 |
| 0.95~0.97 |
| 0.97~1.00 |
| 1.00~1.03 |
| 1.03~1.06 |
| 1.06~1.09 |
| 1.09~1.12 |
| 1.12~1.16 |
| 1.16~1.19 |
| 1.19~1.23 |
| 1.23~1.26 |
| 1.26~1.30 |
| 1.30~1.34 |
| 1.34~1.38 |
| 1.38~1.42 |
| 1.42~1.46 |
| 1.46~1.50 |
| 1.50~1.55 |
| 1.55~1.59 |
| 1.59~1.64 |
| 1.64~1.69 |
| 1.69~1.73 |
| 1.73~1.79 |
| 1.79~1.84 |
| 1.84~1.89 |
| 1.89~1.95 |
| 1.95~2.00 |
| 2.00~2.06 |
| 2.06~2.12 |
| 2.12~2.18 |
| 2.18~2.25 |
| 2.25~2.31 |
| 2.31~2.38 |
| 2.38~2.45 |
| 2.45~2.52 |
| 2.52~2.60 |
| 2.60~2.67 |
| 2.67~2.75 |
| 2.75~2.83 |
| 2.83~2.91 |
| 2.91~3.00 |
| 3.00~3.09 |
| 3.09~3.18 |
| 3.18~3.27 |
| 3.27~3.37 |
| 3.37~3.46 |
| 3.46~3.57 |
| 3.57~3.67 |
| 3.67~3.78 |
| 3.78~3.89 |
| 3.89~4.00 |
| 4.00~4.12 |
| 4.12~4.24 |
| 4.24~4.36 |
| 4.36~4.49 |
| 4.49~4.62 |
| 4.62~4.76 |
| 4.76~4.90 |
| 4.90~5.04 |
| 5.04~5.19 |
| 5.19~5.34 |
| 5.34~5.49 |
| 5.49~5.65 |
| 5.65~5.82 |

TABLE 1-continued

| Particle diameter range (μm) |
|---|
| 5.82~5.99 |
| 5.99~6.16 |
| 6.16~6.34 |
| 6.34~6.53 |
| 6.53~6.72 |
| 6.72~6.92 |
| 6.92~7.12 |
| 7.12~7.33 |
| 7.33~7.54 |
| 7.54~7.76 |
| 7.76~7.99 |
| 7.99~8.22 |
| 8.22~8.46 |
| 8.46~8.71 |
| 8.71~8.96 |
| 8.96~9.22 |
| 9.22~9.49 |
| 9.49~9.77 |
| 9.77~10.05 |
| 10.05~10.35 |
| 10.35~10.65 |
| 10.65~10.96 |
| 10.96~11.28 |
| 11.28~11.61 |
| 11.61~11.95 |
| 11.95~12.30 |
| 12.30~12.66 |
| 12.66~13.03 |
| 13.03~13.41 |
| 13.41~13.80 |
| 13.80~14.20 |
| 14.20~14.62 |
| 14.62~15.04 |
| 15.04~15.48 |
| 15.48~15.93 |
| 15.93~16.40 |
| 16.40~16.88 |
| 16.88~17.37 |
| 17.37~17.88 |
| 17.88~18.40 |
| 18.40~18.94 |
| 18.94~19.49 |
| 19.49~20.06 |
| 20.06~20.65 |
| 20.65~21.25 |
| 21.25~21.87 |
| 21.87~22.51 |
| 22.51~23.16 |
| 23.16~23.84 |
| 23.84~24.54 |
| 24.54~25.25 |
| 25.25~25.99 |
| 25.99~26.75 |
| 26.75~27.53 |
| 27.53~28.33 |
| 28.33~29.16 |
| 29.16~30.01 |
| 30.01~30.89 |
| 30.89~31.79 |
| 31.79~32.72 |
| 32.72~33.67 |
| 33.67~34.65 |
| 34.65~35.67 |
| 35.67~36.71 |
| 36.71~37.78 |
| 37.78~38.88 |
| 38.88~40.02 |
| 40.02~41.18 |
| 41.18~42.39 |
| 42.39~43.62 |
| 43.62~44.90 |
| 44.90~46.21 |
| 46.21~47.56 |
| 47.56~48.94 |
| 48.94~50.37 |

TABLE 1-continued

| Particle diameter range (μm) |
|---|
| 50.37~51.84 |
| 51.84~53.36 |
| 53.36~54.91 |
| 54.91~56.52 |
| 56.52~58.17 |
| 58.17~59.86 |
| 59.86~61.61 |
| 61.61~63.41 |
| 63.41~65.26 |
| 65.26~67.16 |
| 67.16~69.12 |
| 69.12~71.14 |
| 71.14~73.22 |
| 73.22~75.36 |
| 75.36~77.56 |
| 77.56~79.82 |
| 79.82~82.15 |
| 82.15~84.44 |
| 84.55~87.01 |
| 87.01~89.55 |
| 89.55~92.17 |
| 92.17~94.86 |
| 94.86~97.63 |
| 97.63~100.48 |
| 100.48~103.41 |
| 103.41~106.43 |
| 106.43~109.53 |
| 109.53~112.73 |
| 112.73~116.02 |
| 116.02~119.41 |
| 119.41~122.89 |
| 122.89~126.48 |
| 126.48~130.17 |
| 130.17~133.97 |
| 133.97~137.88 |
| 137.88~141.90 |
| 141.90~146.05 |
| 146.05~150.31 |
| 150.31~154.70 |
| 154.70~159.21 |
| 159.21~163.86 |
| 163.86~168.64 |
| 168.64~173.56 |
| 173.56~178.63 |
| 178.63~183.84 |
| 183.84~189.21 |
| 189.21~194.73 |
| 194.73~200.41 |
| 200.41~206.26 |
| 206.26~212.28 |
| 212.28~218.48 |
| 218.48~224.86 |
| 224.86~231.42 |
| 231.42~238.17 |
| 238.17~245.12 |
| 245.12~252.28 |
| 252.28~259.64 |
| 259.64~267.22 |
| 267.22~275.02 |
| 275.02~283.05 |
| 283.05~291.31 |
| 291.31~299.81 |
| 299.81~308.56 |
| 308.56~317.56 |
| 317.56~326.83 |
| 326.83~336.37 |
| 336.37~346.19 |
| 346.19~356.29 |
| 356.29~366.69 |
| 366.69~377.40 |
| 377.40~388.41 |
| 388.41~400.00 |

(10) Penetration thickness L (μm) at penetration time of 5 seconds, average penetration velocity Va (μm/s) at penetration time of 5 seconds or more and 10 seconds or less, and average penetration velocity Vb (μm/s) at penetration time of 10 seconds or more and 15 seconds or less when UV curable composition is caused to penetrate Toner as a target of measurement was loaded from above a cylindrical container having a diameter of 1 mm and containing a UV curable composition LUXTRACK D-800 (composition containing tri(ethylene glycol) dimethacrylate and an acrylic-modified urethane oligomer having hexamethylene diisocyanate, an OH group-containing methacrylate, and a propylene oxide adduct of bisphenol A bonded to the oligomer; manufactured by TOAGOSEI CO., LTD.), and the UV curable composition was caused to penetrate into the toner for 5 seconds. After that, the sample was placed at a distance of 3.0±0.1 cm from the irradiation portion of, for example, an IRRADIATOR LS-800 (manufactured by JEOL DATUM), and was irradiated with UV light at an output of 150 W for 30 seconds so that the UV curable composition was cured in the toner. The toner where the UV curable composition had been caused to penetrate and had been cured was turned into a toner slice having a thickness of 50 to 100 nm with, for example, an ULTRACUT UCT (manufactured by Leica Microsystems). Upon production of the slice, attention was paid so that the slice was formed of the center portion of each toner particle. The toner slice was observed with, for example, a field emission scanning electron microscope S-4800 (manufactured by Hitachi High-Technologies Corporation), and the transmission electron image (STEM image) of the toner slice was obtained.

The penetration thickness of the UV curable composition in the transmission electron image was represented by L. It should be noted that a penetration thickness (La) in each particle was defined as represented by the following equation when the penetration thickness of the UV curable composition in the long axis direction in the toner slice was represented by Lx and the penetration thickness of the UV curable composition in the short axis direction in the toner slice was represented by Ly.

$$La=(Lx+Ly)/2$$

In addition, toner particles each having a particle diameter in the range of the number average particle diameter D1 of the toner ±0.2 μm were selected, and the penetration thicknesses of the particles were measured in order that a measurement error might be eliminated to the extent possible. The measurement was performed as described below. 100 arbitrary particles each satisfying the above condition were selected, and the penetration thickness La of each of the particles was measured. Ten highest values including the maximum and ten lowest values including the minimum were eliminated from the results of the measurement, and the remaining eighty results were used as data. The penetration thickness L at a penetration time of 5 seconds was determined by arithmetically averaging the eighty results.

Similarly, the toner into which the UV curable composition was caused to penetrate for 10 seconds was turned into a slice. As in the case of the penetration thickness L, penetration thicknesses in 100 toner particles were measured. Ten highest values including the maximum and ten lowest values including the minimum were eliminated from the results of the measurement, and the remaining eighty results were used as data. The arithmetic average of the eighty results was defined as a penetration thickness $L_{10}$ at a penetration time of 10 seconds. In this case, an average penetration velocity Va at a penetration time of 5 seconds or more and 10 seconds or less was defined as represented by the following equation.

$$Va=(L_{10}-L)/5$$

Similarly, the toner into which the UV curable composition was caused to penetrate for 15 seconds was turned into a slice. As in the case of the penetration thickness L, penetration thicknesses in 100 toner particles were measured. Ten highest values including the maximum and ten lowest values including the minimum were eliminated from the results of the measurement, and the remaining eighty results were used as data. The arithmetic average of the eighty results was defined as a penetration thickness $L_{15}$ at a penetration time of 15 seconds. In this case, an average penetration velocity Vb at a penetration time of 10 seconds or more and 15 seconds or less was defined as represented by the following equation.

$$Vb=(L_{15}-L_{10})/5$$

Figure 2:
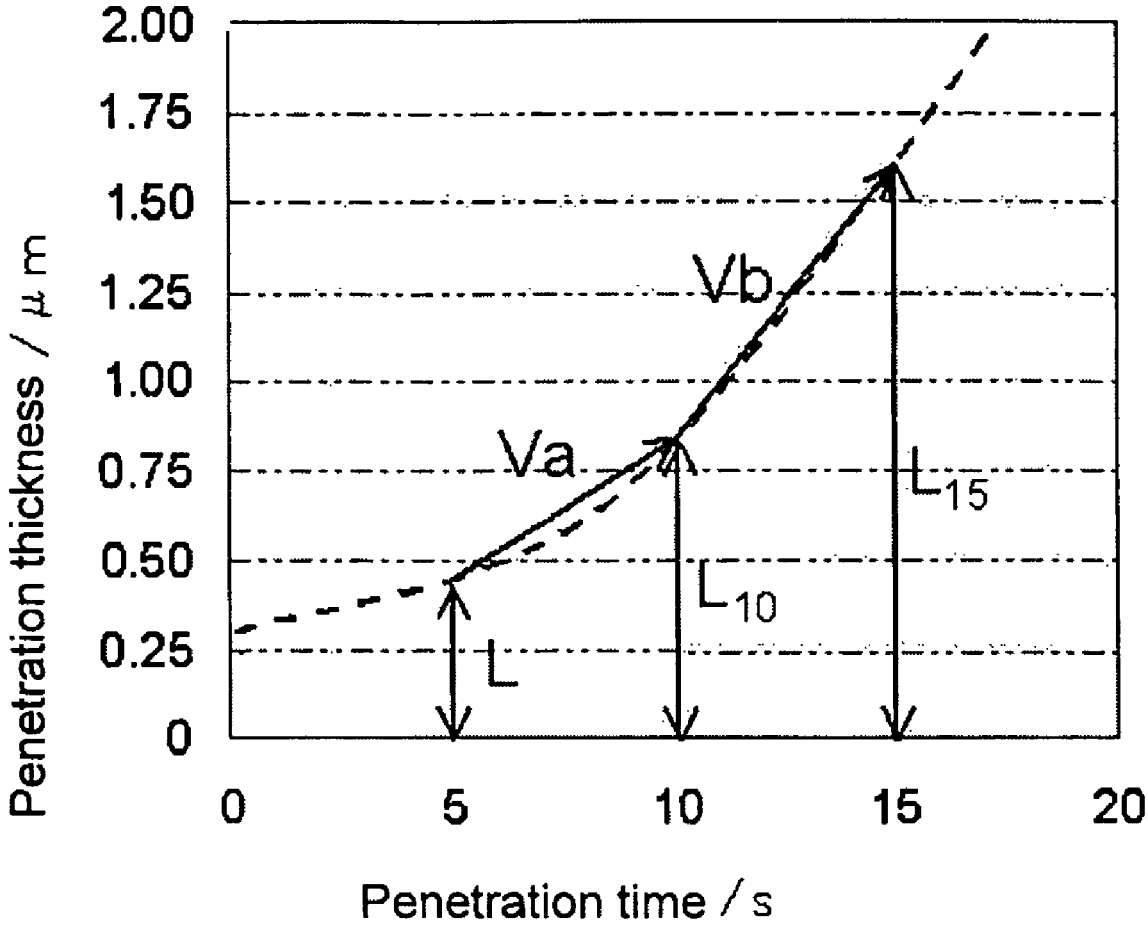
FIG. 2 is a view showing a penetration time-penetration thickness curve when a UV curable composition penetrates into toner, and showing L, Va, and Vb.

FIG. 2 shows an image of a relationship between a penetration thickness and a penetration time in this case. It should be noted that a penetration thickness at a penetration time of zero seconds is a penetration thickness determined in the same manner as in the measurement of the penetration thickness L by using a sample upon irradiation with UV light immediately after the toner has been loaded into the UV curable composition. The reason why the penetration thickness is not zero micrometers at a penetration time of zero seconds is that the UV curable composition penetrates while the composition is cured by being irradiated with UV light. Although "a penetration time of 5 seconds", "a penetration time of 10 seconds", and "a penetration time of 15 seconds" are specified in the description, strictly speaking, an actual penetration time includes a time required for the UV curable composition to cure by being irradiated with UV light as well as each specified time.

(11) Change Ratio of Weight-Average Particle Diameter (D4) after Stirring Under Heat to Weight-Average Particle Diameter Before Stirring Under Heat 1.7 parts of the particles of toner were loaded into 100 parts of ion-exchanged water, and the mixture was stirred with a paddle stirring blade at 300 r/min so that the toner particles were dispersed in ion-exchanged water. After that, the temperature of the toner particle dispersion liquid was increased so as to be higher than the glass transition temperature (TgA) of the toner by 5° C., and then the dispersion liquid was continuously stirred for 60 minutes. After the completion of the stirring, a product obtained by filtrating the dispersion liquid was defined as a measurement sample, and the weight-average particle diameter (D4) of the sample was measured by the above-mentioned method. The change ratio of the weight-average particle diameter (D4) was determined from the resultant measured value on the basis of the following equation.

Change ratio of weight-average particle diameter (*D*4) (%)=(weight-average particle diameter of toner particles after stirring under heat/weight-average particle diameter of toner particles before stirring under heat)×100

(12) Degree of Agglomeration of Toner after Toner has been Left to Stand at Temperature of 50° C. and Humidity of 10% RH for 3 Days 5 g of toner were weighed in a 100-ml polycup. Next, the sample was loaded into a thermostat set to 50° C., and was left at rest for 3 days. After that, the sample was taken out, and was left to stand in an environment having a temperature of 23° C. and a humidity of 60% RH for 24 hours. After that, the degree of agglomeration of the toner was measured.

The degree of agglomeration of the toner was measured as described below.

A measuring apparatus used was such that a digital display vibration meter "DIGIVIBLO MODEL 1332A" (manufactured by Showa Sokki Corporation) was connected to a side surface portion of the vibrating table of a "Powder Tester" (manufactured by Hosokawa Micron Corporation). Then, a sieve having an aperture of 250 μm, a sieve having an aperture of 500 μm, and a sieve having an aperture of 710 μm were set like a laminate in the stated order from below on the vibrating table of the Powder Tester. Measurement was performed under the environment at 23° C. and 60% RH as described below.

(i) The amplitude of the vibrating table was previously adjusted so that the displacement of the digital display vibration meter was 0.40 mm (peak-to-peak).

(ii) 5 g of the toner previously left to stand under the environment at 23° C. and 60% RH for 24 hours were precisely weighed and gently placed on the sieve having an aperture of 710 μm as the uppermost stage.

The sieves were vibrated for 10 seconds. After that, the mass of the toner remaining on each sieve was measured, and the degree of agglomeration was calculated on the basis of the following equation.

Degree of agglomeration (%)={(mass (g) of sample on sieve having aperture of 710 μm)/5 (g)}×100+{(mass (g) of sample on sieve having aperture of 500 μm)/5 (g)}×100×0.6+{(mass (g) of sample on sieve having aperture of 250 μm)/5 (g)}×100×0.2

(13) Determination of Amount of Ether Compound

The amount of an ether compound in toner was measured by a multiple headspace extraction method.

(Apparatus and Instrument)

The determination was performed by using an HS40XL manufactured by PerkinElmer Japan Co., Ltd. as a headspace sampler, and a TRACE GC or TRACE MS manufactured by ThermoQuest Corp. as a GC/MS. In addition, a peak area based on the multiple headspace extraction method was calculated by using the following approximation equation.

$$\Sigma A_n = A^2 1/(A_1 - A_2) \quad \text{[Num 2]}$$

($\Sigma A_n$: Total peak area, $A_n$: Peak area upon n-th extraction)

A sample vial was connected to a gas chromatograph, and was analyzed by employing the multiple headspace extraction method.

(i) Condition of Headspace Sampler

Sample amount: 50 mg

Vial: 22 ml

Sample temperature: 120° C.

Needle temperature: 150° C.

Transfer line temperature: 180° C.

Retention time: 60 min

Pressing time: 0.25 min

Injection time: 0.08 min (ii) Condition of GC

Column: HP5-MS (0.25 mm, 60 m)

Column temperature: retention at 40° C. for 3 minutes, temperature increment of 2.0° C./min between 40 to 70° C., temperature increment of 5° C./min between 70 to 150° C., and temperature increment of 10.0° C./min between 150 to 300° C.

Split ratio 50:1

(iii) Instrument

A vial (22 ml) formed of glass for headspace analysis manufactured by PerkinElmer Japan Co., Ltd. was used as a closed vessel.

(iv) Method (1) Preparation of Standard Sample

First, a solution of the ether compound in methanol having a concentration of 1,000 ppm was prepared as a standard sample for the determination of the amount of the ether compound. 5 μl of the solution were charged into the 22-ml vial formed of glass with a microsyringe having a volume of 10 μl. Immediately after that, the vial was tightly stopped with a septum for high-temperature analysis.

In addition, when the structure of the ether compound is unclear, the following procedure can be adopted: the structure is identified by an analysis method such as gas chromatography-mass spectrometry (GC-MS) or liquid chromatography-mass spectrometry (LC-MS), and the amount of the substance with its structure identified is determined by the above-mentioned method.

(2) Production of Toner Sample 50 mg of the toner were loaded into a 22-ml vial formed of glass, and the vial was tightly stopped with a septum for high-temperature analysis, whereby a sample was obtained.

(v) Analysis

A total peak area per 0.005 μl of the ether compound was determined by subjecting the standard sample of the ether compound to measurement by a quantitative multiple headspace extraction method (it should be noted that a peak area per 0.005 μl of the ether compound must be checked every time measurement is performed because the sensitivity of GC varies on a daily basis). Next, the volume of the ether compound in the measurement sample was determined from the total peak area of the toner determined by the quantitative multiple headspace extraction method and the total peak area of the standard sample of the ether compound by proportional calculation. The calculated value was multiplied by the specific gravity of the ether compound so that the volume was converted into the mass of the ether compound. Thus, the concentration of the ether compound in the toner was calculated.

EXAMPLE 1

The present invention will be described specifically by way of the following examples. However, the present invention is by no means limited by these examples.

Cyan Toner Production Example 1

A toner was produced in accordance with the following procedure.

9 parts by mass of tricalcium phosphate and 11 parts by mass of 10% hydrochloric acid were added to 1,300 parts by mass of ion-exchanged water heated to 60° C., and the mixture was stirred with a TK-HOMOMIXER (manufactured by Tokushu Kika Kogyo) at 10,000 rpm, whereby an aqueous medium having a pH of 5.2 was prepared.

In addition, the following materials were dissolved with a propeller stirring device at 100 rpm, whereby a solution was prepared.

| | |
|---|---|
| Styrene | 70.0 parts by mass |
| n-butyl acrylate | 30.0 parts by mass |
| Toluene | 2.5 parts by mass |
| Charge control agent: FCA1001NS (vinyl polymer having a sulfonic group; manufactured by FUJIKURA KASEI CO., LTD.) | 1.0 part by mass |
| Polar resin 1: styrene-methacrylic acid-methyl methacrylate copolymer (Copolymerization ratio (mass basis) = 95.6:1.7:2.7, Mp = 69,000, Mw = 68,000, Tg = 102° C., acid value = 12.0 mgKOH/g, Mw/Mn = 2.1, amount of remaining styrene = 90 ppm) | 20.0 parts by mass |

Next, the following materials were added to the solution.

| | |
|---|---|
| C.I. Pigment Blue 15:3 | 7.0 parts by mass |
| Charge control agent: BONTRON E-88 (aluminum salicylate compound; manufactured by Orient Chemical Industries, LTD.) | 1.0 part by mass |
| Wax: HNP-10 (melting point 75° C.; manufactured by Nippon Seiro Co., Ltd.) | 10.0 parts by mass |
| Di-t-butyl ether (Ether Compound 1) | 0.05 part by mass |

After that, the temperature of the mixed liquid was increased to 60° C., and then the mixed liquid was stirred with a TK-HOMOMIXER (manufactured by Tokushu Kika Kogyo) at 9,000 rpm so that the above materials were dissolved and dispersed in the solution.

8.0 parts by mass of 2,2'-azobis(2,4-dimethylvaleronitrile) as a polymerization initiator were dissolved in the resultant, whereby a polymerizable monomer composition was prepared. The polymerizable monomer composition was loaded into the aqueous medium, and the mixture was stirred with a TK-HOMOMIXER at 60° C. and 10,000 rpm for 30 minutes so that the polymerizable monomer composition was granulated.

After that, the resultant was transported to a propeller stirring device, and was subjected to a reaction under a nitrogen atmosphere at a dissolved oxygen content of 0.50% or less and 70° C. for 5 hours while being stirred at 100 rpm. After that, the temperature of the resultant was increased to 80° C., and the resultant was subjected to a reaction for an additional 5 hours, whereby toner particles were produced. After the completion of the polymerization reaction, slurry containing the particles was cooled, washed with water in an amount ten times as large as that of the slurry, filtrated, dried, and classified so that the diameters of the particles were adjusted. Thus, cyan toner particles were obtained.

2.0 parts by mass of a flowability improver (hydrophobic silica fine powder (primary particle diameter: 10 nm, BET specific surface area: 170 $m^2/g$) treated with dimethyl silicone oil (20 mass %) and charged with polarity identical to that of each of the cyan toner particles (negative polarity)) were externally added to and mixed in 100 parts by mass of the toner particles with a HENSCHEL MIXER (manufactured by Mitsui Miike Machinery Co., Ltd.) at 3,000 rpm for 15 minutes, whereby Cyan Toner 1 was obtained. Table 2 shows the physical properties of Cyan Toner 1 obtained here.

Cyan Toner Production Example 2

| | |
|---|---|
| Styrene | 70.0 parts by mass |
| n-butyl acrylate | 30.0 parts by mass |
| Toluene | 2.5 parts by mass |
| FCA1001NS (manufactured by FUJIKURA KASEI CO., LTD.) | 1.0 part by mass |
| Polar resin 1 described above | 20.0 parts by mass |
| C.I. Pigment Blue 15:3 | 7.0 parts by mass |
| BONTRON E-88 (manufactured by Orient Chemical Industries, LTD.) | 1.0 part by mass |
| WEP-3 (melting point 73° C.; manufactured by Nippon Yushi Co., Ltd.) | 10.0 parts by mass |
| t-hexyl-t-butyl ether (Ether Compound 2) | 0.05 part by mass |
| 2,2'-azobis(2,4-dimethylvaleronitrile) | 8.0 parts by mass |

Cyan Toner 2 was obtained by the same method as the production method for Cyan Toner 1 except that the formulation was changed to the materials and the addition amounts described above. Table 2 shows the physical properties of Cyan Toner 2.

Cyan Toner Production Example 3

| | |
|---|---|
| Styrene | 70.0 parts by mass |
| n-butyl acrylate | 30.0 parts by mass |
| Toluene | 2.5 parts by mass |
| FCA1001NS (manufactured by FUJIKURA KASEI CO., LTD.) | 1.0 part by mass |
| Polar resin 1 described above | 20.0 parts by mass |
| C.I. Pigment Blue 15:3 | 7.0 parts by mass |
| BONTRON E-88 (manufactured by Orient Chemical Industries, LTD.) | 1.0 part by mass |
| HNP-10 (melting point 75° C.; manufactured by Nippon Seiro Co., Ltd.) | 10.0 parts by mass |
| Di(di-1-hexyl)heptyl ether(Ether Compound 3) | 0.05 part by mass |
| 2,2'-azobis(2,4-dimethylvaleronitrile) | 8.0 parts by mass |

Cyan Toner 3 was obtained by the same method as the production method for Cyan Toner 1 except that the formulation was changed to the materials and the addition amounts described above. Table 2 shows the physical properties of Cyan Toner 3.

Cyan Toner Production Example 4

The polymerizable monomer composition was granulated in the same manner as in Cyan Toner 1, and then the resultant was subjected to a polymerization reaction at 70° C. for 4 hours. After that, the resultant was stirred with a TK-HOMOMIXER at 10,000 rpm for 10 minutes. After that, the temperature of the resultant was increased to 80° C., and the resultant was subjected to a polymerization reaction for an additional 5 hours, whereby toner particles were produced.

Cyan Toner 4 was obtained in the same manner as in Cyan Toner 1 except that the toner particles obtained in the foregoing were used. Table 2 shows the physical properties of Cyan Toner 4.

Cyan Toner Production Example 5

| | |
|---|---|
| Styrene | 72.5 parts by mass |
| n-butyl acrylate | 27.5 parts by mass |
| Toluene | 2.5 parts by mass |
| FCA1001NS (manufactured by FUJIKURA KASEI CO., LTD.) | 1.0 part by mass |
| Polar resin 2: styrene-n-butyl acrylate-methacrylic acid-methyl methacrylate copolymer (Copolymerization ratio = 83.6:12.0:1.7:2.7, Mp = 69,000, Mw = 68,000, Tg = 80° C., acid value = 12.0 mgKOH/g, Mw/Mn = 2.1, amount of remaining styrene = 80 ppm) | 20.0 parts by mass |
| C.I. Pigment Blue 15:3 | 7.0 parts by mass |
| BONTRON E-88 (manufactured by Orient Chemical Industries, LTD.) | 1.0 part by mass |
| HNP-10 (melting point 75° C.; manufactured by Nippon Seiro Co., Ltd.) | 10.0 parts by mass |
| Di-t-butyl ether (Ether Compound 1) | 0.05 part by mass |
| 2,2'-azobis(2,4-dimethylvaleronitrile) | 8.0 parts by mass |

Cyan Toner 5 was obtained by the same method as the production method for Cyan Toner 1 except that the formulation was changed to the materials and the addition amounts described above. Table 2 shows the physical properties of Cyan Toner 5.

Cyan Toner Production Example 6

| | |
|---|---|
| Styrene | 68.0 parts by mass |
| n-butyl acrylate | 32.0 parts by mass |
| Toluene | 2.5 parts by mass |
| FCA1001NS (manufactured by FUJIKURA KASEI CO., LTD.) | 1.0 part by mass |
| Polar resin 3: styrene-αmethylstyrene-methacrylic acid-methyl methacrylate copolymer (Copolymerization ratio = 65.6:30.0:1.7:2.7, Mp = 44,000, Mw = 43,000, Tg = 120° C., acid value = 12.0 mgKOH/g, Mw/Mn = 2.1, amount of remaining styrene = 100 ppm) | 20.0 parts by mass |
| C.I. Pigment Blue 15:3 | 7.0 parts by mass |
| BONTRON E-88 (manufactured by Orient Chemical Industries, LTD.) | 1.0 part by mass |
| HNP-10 (melting point 75° C.; manufactured by Nippon Seiro Co., Ltd.) | 10.0 parts by mass |
| Di-t-butyl ether (Ether Compound 1) | 0.05 part by mass |
| 2,2'-azobis(2,4-dimethylvaleronitrile) | 8.0 parts by mass |

Cyan Toner 6 was obtained by the same method as the production method for Cyan Toner 1 except that the formulation was changed to the materials and the addition amounts described above. Table 2 shows the physical properties of Cyan Toner 6.

Cyan Toner Production Example 7

| | |
|---|---|
| Styrene | 70.0 parts by mass |
| n-butyl acrylate | 30.0 parts by mass |
| Toluene | 2.5 parts by mass |
| FCA1001NS (manufactured by FUJIKURA KASEI CO., LTD.) | 1.0 part by mass |
| Polar resin 4: styrene-methacrylic acid-methyl methacrylate copolymer (Copolymerization ratio = 91.6:5.7:2.7, Mp = 69,000, Mw = 68,000, Tg = 102° C., acid value = 40.0 mgKOH/g, Mw/Mn = 2.1, amount of remaining styrene = 90 ppm) | 20.0 parts by mass |
| C.I. Pigment Blue 15:3 | 7.0 parts by mass |
| BONTRON E-88 (manufactured by Orient Chemical Industries, LTD.) | 1.0 part by mass |
| HNP-10 (melting point 75° C.; manufactured by Nippon Seiro Co., Ltd.) | 10.0 parts by mass |
| Di-t-butyl ether (Ether Compound 1) | 0.05 part by mass |
| 2,2'-azobis(2,4-dimethylvaleronitrile) | 8.0 parts by mass |

Cyan Toner 7 was obtained by the same method as the production method for Cyan Toner 1 except that the formulation was changed to the materials and the addition amounts described above. Table 2 shows the physical properties of Cyan Toner 7.

Cyan Toner Production Example 8

| | |
|---|---|
| Styrene | 70.0 parts by mass |
| n-butyl acrylate | 30.0 parts by mass |
| Toluene | 2.5 parts by mass |
| FCA1001NS (manufactured by FUJIKURA KASEI CO., LTD.) | 1.0 part by mass |

-continued

| | |
|---|---|
| Polar resin 5: styrene-methacrylic acid-methyl methacrylate copolymer (Copolymerization ratio = 96.6:0.7:2.7, Mp = 69,000, Mw = 68,000, Tg = 102° C., acid value = 5.0 mgKOH/g, Mw/Mn = 2.1, amount of remaining styrene = 90 ppm) | 20.0 parts by mass |
| C.I. Pigment Blue 15:3 | 7.0 parts by mass |
| BONTRON E-88 (manufactured by Orient Chemical Industries, LTD.) | 1.0 part by mass |
| HNP-10 (melting point 75° C.; manufactured by Nippon Seiro Co., Ltd.) | 1.0 parts by mass |
| Di-t-butyl ether (Ether Compound 1) | 0.05 part by mass |
| 2,2'-azobis(2,4-dimethylvaleronitrile) | 8.0 parts by mass |

Cyan Toner 8 was obtained by the same method as the production method for Cyan Toner 1 except that the formulation was changed to the materials and the addition amounts described above. Table 2 shows the physical properties of Cyan Toner 8.

Cyan Toner Production Example 9

| | |
|---|---|
| Styrene | 64.0 parts by mass |
| n-butyl acrylate | 36.0 parts by mass |
| Toluene | 2.5 parts by mass |
| FCA1001NS (manufactured by FUJIKURA KASEI CO., LTD.) | 1.0 part by mass |
| Polar resin 1 described above | 40.0 parts by mass |
| C.I. Pigment Blue 15:3 | 7.0 parts by mass |
| BONTRON E-88 (manufactured by Orient Chemical Industries, LTD.) | 1.0 part by mass |
| HNP-10 (melting point 75° C.; manufactured by Nippon Seiro Co., Ltd.) | 10.0 parts by mass |
| Di-t-butyl ether (Ether Compound 1) | 0.05 part by mass |
| 2,2'-azobis(2,4-dimethylvaleronitrile) | 8.0 parts by mass |

Cyan Toner 9 was obtained by the same method as the production method for Cyan Toner 1 except that the formulation was changed to the materials and the addition amounts described above. Table 2 shows the physical properties of Cyan Toner 9.

Cyan Toner Production Example 10

| | |
|---|---|
| Styrene | 71.0 parts by mass |
| n-butyl acrylate | 29.0 parts by mass |
| Toluene | 2.5 parts by mass |
| FCA1001NS (manufactured by FUJIKURA KASEI CO., LTD.) | 1.0 part by mass |
| Polar resin 1 described above | 20.0 parts by mass |
| C.I. Pigment Blue 15:3 | 7.0 parts by mass |
| BONTRON E-88 (manufactured by Orient Chemical Industries, LTD.) | 1.0 part by mass |
| HI-MIC-1045 (melting point 70° C.; manufactured by Nippon Seiro Co., Ltd.) | 10.0 parts by mass |
| Di-t-butyl ether (Ether Compound 1) | 0.05 part by mass |
| 2,2'-azobis(2,4-dimethylvaleronitrile) | 8.0 parts by mass |

Cyan Toner 10 was obtained by the same method as the production method for Cyan Toner 1 except that the formulation was changed to the materials and the addition amounts described above. Table 2 shows the physical properties of Cyan Toner 10.

Cyan Toner Production Example 11

| | |
|---|---|
| Styrene | 75.0 parts by mass |
| n-butyl acrylate | 25.0 parts by mass |
| Chain transfer agent: t-dodecyl mercaptan (loaded at the stage of preparation of a solution) | 1.0 part by mass |
| Toluene | 2.5 parts by mass |
| FCA1001NS (manufactured by FUJIKURA KASEI CO., LTD.) | 1.0 part by mass |
| Polar resin 1 described above | 4.0 parts by mass |
| C.I. Pigment Blue 15:3 | 7.0 parts by mass |
| BONTRON E-88 (manufactured by Orient Chemical Industries, LTD.) | 1.0 part by mass |
| HNP-10 (melting point 75° C.; manufactured by Nippon Seiro Co., Ltd.) | 10.0 parts by mass |
| Di-t-butyl ether (Ether Compound 1) | 0.05 part by mass |
| 2,2'-azobis(2,4-dimethylvaleronitrile) | 8.0 parts by mass |

Cyan Toner 11 was obtained by the same method as the production method for Cyan Toner 1 except that the formulation was changed to the materials and the addition amounts described above. Table 2 shows the physical properties of Cyan Toner 11.

Cyan Toner Production Example 12

| | |
|---|---|
| Styrene | 75.0 parts by mass |
| n-butyl acrylate | 25.0 parts by mass |
| Toluene | 2.5 parts by mass |
| FCA1001NS (manufactured by FUJIKURA KASEI CO., LTD.) | 1.0 part by mass |
| Polar resin 6: styrene-methacrylic acid-methyl methacrylate copolymer (Copolymerization ratio = 95.6:1.7:2.7, Mp = 250,000, Mw = 240,000, Tg = 102° C., acid value = 12.0 mgKOH/g, Mw/Mn = 2.1, amount of remaining styrene = 100 ppm) | 20.0 parts by mass |
| C.I. Pigment Blue 15:3 | 7.0 parts by mass |
| BONTRON E-88 (manufactured by Orient Chemical Industries, LTD.) | 1.0 part by mass |
| HNP-10 (melting point 75° C.; manufactured by Nippon Seiro Co., Ltd.) | 10.0 parts by mass |
| Di-t-butyl ether (Ether Compound 1) | 0.05 part by mass |
| 2,2'-azobis(2,4-dimethylvaleronitrile) | 8.0 parts by mass |

Cyan Toner 12 was obtained by the same method as the production method for Cyan Toner 1 except that the formulation was changed to the materials and the addition amounts described above. Table 2 shows the physical properties of Cyan Toner 12.

Cyan Toner Production Example 13

Cyan Toner 13 was obtained in the same manner as in Cyan Toner 1 except that Ether Compound 1 was not added. Table 2 shows the physical properties of Cyan Toner 13.

Cyan Toner Production Example 14

| | |
|---|---|
| Styrene | 73.0 parts by mass |
| n-butyl acrylate | 27.0 parts by mass |

-continued

| | |
|---|---|
| Toluene | 2.5 parts by mass |
| FCA1001NS (manufactured by FUJIKURA KASEI CO., LTD.) | 1.0 part by mass |
| Polar resin 7: styrene-methacrylic acid-methyl methacrylate copolymer (Copolymerization ratio = 95.6:1.7:2.7, Mp = 500,000, Mw = 480,000, Tg = 102° C., acid value = 12.0 mgKOH/g, Mw/Mn = 2.1, amount of remaining styrene = 90 ppm) | 10.0 parts by mass |
| C.I. Pigment Blue 15:3 | 7.0 parts by mass |
| BONTRON E-88 (manufactured by Orient Chemical Industries, LTD.) | 1.0 part by mass |
| HNP-10 (melting point 75° C.; manufactured by Nippon Seiro Co., Ltd.) | 10.0 parts by mass |
| Di-t-butyl ether (Ether Compound 1) | 0.05 part by mass |
| 2,2'-azobis(2,4-dimethylvaleronitrile) | 8.0 parts by mass |

Cyan Toner 14 was obtained by the same method as the production method for Cyan Toner 1 except that the formulation was changed to the materials and the addition amounts described above. Table 2 shows the physical properties of Cyan Toner 14.

Cyan Toner Production Example 15

| | |
|---|---|
| Styrene | 64.0 parts by mass |
| n-butyl acrylate | 36.0 parts by mass |
| Toluene | 2.5 parts by mass |
| FCA1001NS (manufactured by FUJIKURA KASEI CO., LTD.) | 1.0 part by mass |
| Polar resin 8: styrene-n-butyl acrylate-methacrylic acid-methyl methacrylate copolymer (Copolymerization ratio = 83.6:12.0:1.7:2.7, Mp = 10,000, Mw = 10,000, Tg = 80° C., acid value = 12.0 mgKOH/g, Mw/Mn = 2.1, amount of remaining styrene = 80 ppm) | 20.0 parts by mass |
| C.I. Pigment Blue 15:3 | 7.0 parts by mass |
| BONTRON E-88 (manufactured by Orient Chemical Industries, LTD.) | 1.0 part by mass |
| HNP0190 (melting point 90° C.; manufactured by Nippon Seiro Co., Ltd.) | 10.0 parts by mass |
| Di-t-butyl ether (Ether Compound 1) | 0.05 part by mass |
| 2,2'-azobis(2,4-dimethylvaleronitrile) | 8.0 parts by mass |

Cyan Toner 15 was obtained by the same method as the production method for Cyan Toner 1 except that the formulation was changed to the materials and the addition amounts described above. Table 2 shows the physical properties of Cyan Toner 15.

Cyan Toner Production Example 16

(Preparation of Wax Coarse Dispersion Liquid)

| | |
|---|---|
| Styrene monomer | 68.0 parts by mass |
| PW2000PE (melting point 124° C.; manufactured by TOYO-PETROLITE) | 10.0 parts by mass |

The above components were loaded into a container the temperature of which could be adjusted, and the mixed liquid was stirred with an ULTRATURRAX T-50 (manufactured by IKA) at 10,000 rpm for 40 minutes while the temperature of the liquid was always kept at 40° C. or lower. Thus, a wax coarse dispersion liquid was obtained.

The wax coarse dispersion liquid was charged into a stirring tank the temperature of which could be adjusted. The liquid was transported through a pump to a circulation line with a T.K. FILMIX (manufactured by Tokushu Kika Kogyo) built in its midstream. The liquid was circulated for 2 hours while its temperature was adjusted to 60° C. or lower during the circulating step, whereby a wax fine dispersion liquid was obtained. Particles each having a particle diameter of 2 μm or less accounted for 100% of particles in the liquid on a volume basis.

Next, the following materials were dissolved with a propeller stirring device at 100 rpm, whereby a solution was prepared.

| | |
|---|---|
| Dispersion liquid described above (styrene monomer 68.0 parts by mass, wax 10.0 parts by mass) | 78.0 parts by mass |
| n-butyl acrylate | 32.0 parts by mass |
| Toluene | 2.5 parts by mass |
| Charge control agent FCA1001NS (manufactured by FUJIKURA KASEI CO., LTD.) | 1.0 part by mass |
| Polar resin 1 described above | 20.0 parts by mass |

Next, the following materials were added to the solution.

| | |
|---|---|
| C.I. Pigment Blue 15:3 | 7.0 parts by mass |
| BONTRON E-88 (Manufactured by Orient Chemical Industries, LTD.) | 1.0 part by mass |
| Di-t-butyl ether (Ether Compound 1) | 0.05 part by mass |

After that, the temperature of the mixed liquid was increased to 60° C., and then the mixed liquid was stirred with a TK-HOMOMIXER (manufactured by Tokushu Kika Kogyo) at 9,000 rpm so that the above materials were dissolved and dispersed in the solution.

8.0 parts by mass of 2,2'-azobis(2,4-dimethylvaleronitrile) as a polymerization initiator were dissolved in the resultant, whereby a polymerizable monomer composition was prepared.

After that, toner particles were obtained in the same manner as in Cyan Toner 1. Further, external addition was performed in the same manner as in Cyan Toner 1, whereby Cyan Toner 16 was obtained. Table 2 shows the physical properties of Cyan Toner 16.

Cyan Toner Production Example 17

| | |
|---|---|
| Styrene | 75.0 parts by mass |
| n-butyl acrylate | 25.0 parts by mass |
| Toluene | 2.5 parts by mass |
| FCA1001NS (manufactured by FUJIKURA KASEI CO., LTD.) | 1.0 part by mass |
| Polar resin 6 described above | 20.0 parts by mass |
| C.I. Pigment Blue 15:3 | 7.0 parts by mass |
| BONTRON E-88 (manufactured by Orient Chemical Industries, LTD.) | 1.0 part by mass |
| HNP0109 (melting point 90° C.; manufactured by Nippon Seiro Co., Ltd.) | 10.0 parts by mass |
| Di-t-butyl ether (Ether Compound 1) | 0.05 part by mass |
| 2,2'-azobis(2,4-dimethylvaleronitrile) | 8.5 parts by mass |

Cyan Toner 17 was obtained by the same method as the production method for Cyan Toner 1 except that the formulation was changed to the materials and the addition amounts described above. Table 2 shows the physical properties of Cyan Toner 17.

Cyan Toner Production Example 18

Cyan Toner 18 was obtained in the same manner as in Cyan Toner 1 except that Toluene was not added. Table 2 shows the physical properties of Cyan Toner 18.

Cyan Toner Production Example 19

Cyan Toner 19 was obtained in the same manner as in Cyan Toner 1 except that the addition amount of toluene was changed to 5.0 parts by mass. Table 2 shows the physical properties of Cyan Toner 19.

Cyan Toner Production Example 20

Cyan Toner 20 was obtained in the same manner as in Cyan Toner 1 except that the polymer having a sulfonic group FCA1001NS (manufactured by FUJIKURA KASEI CO., LTD.) was not added. Table 2 shows the physical properties of Cyan Toner 20.

Cyan Toner Production Example 21

Cyan Toner 21 was obtained in the same manner as in Cyan Toner 1 except that the addition amount of the polymer having a sulfonic group FCA1001NS (manufactured by FUJIKURA KASEI CO., LTD.) was changed to 0.3 part by mass. Table 2 shows the physical properties of Cyan Toner 21.

Cyan Toner Production Example 22

Cyan Toner 22 was obtained in the same manner as in Cyan Toner 1 except that the addition amount of the polymer having a sulfonic group FCA1001NS (manufactured by FUJIKURA KASEI CO., LTD.) was changed to 2.0 parts by mass. Table 2 shows the physical properties of Cyan Toner 22.

Cyan Toner Production Example 23

| | |
|---|---|
| Styrene | 55.0 parts by mass |
| n-butyl acrylate | 45.0 parts by mass |
| Toluene | 2.5 parts by mass |
| FCA1001NS (manufactured by FUJIKURA KASEI CO., LTD.) | 1.0 part by mass |
| Polar resin 1 described above | 20.0 parts by mass |
| C.I. Pigment Blue 15:3 | 7.0 parts by mass |
| BONTRON E-88 (manufactured by Orient Chemical Industries, LTD.) | 1.0 part by mass |
| HNP-10 (melting point 75° C.; manufactured by Nippon Seiro Co., Ltd.) | 10.0 parts by mass |
| Di-t-butyl ether (Ether Compound 1) | 0..05 part by mass |
| 2,2'-azobis(2,4-dimethylvaleronitrile) | 8.0 parts by mass |

Cyan Toner 23 was obtained by the same method as the production method for Cyan Toner 1 except that the formulation was changed to the materials and the addition amounts described above. Table 2 shows the physical properties of Cyan Toner 23.

Cyan Toner Production Example 24

Cyan Toner 24 was obtained in the same manner as in Cyan Toner 1 except that: the addition amount of tricalcium phosphate was changed from 9.0 parts by mass to 30.0 parts by mass; and the polar resin was not added. Table 2 shows the physical properties of Cyan Toner 24.

Cyan Toner Production Example 25

| | |
|---|---|
| Styrene | 72.5 parts by mass |
| n-butyl acrylate | 27.5 parts by mass |
| t-dodecyl mercaptan (loaded at the stage of the preparation of a solution) | 1.0 part by mass |
| Toluene | 2.5 parts by mass |
| FCA1001NS (manufactured by FUJIKURA KASEI CO., LTD.) | 1.0 part by mass |
| Polar resin 8 described above | 20.0 parts by mass |
| C.I. Pigment Blue 15:3 | 7.0 parts by mass |
| BONTRON E-88 (manufactured by Orient Chemical Industries, LTD.) | 1.0 part by mass |
| HNP-10 (melting point 75° C.; manufactured by Nippon Seiro Co., Ltd.) | 10.0 parts by mass |
| Di-t-butyl ether (Ether Compound 1) | 0.05 part by mass |
| 2,2'-azobis(2,4-dimethylvaleronitrile) | 8.0 parts by mass |

Cyan Toner 25 was obtained by the same method as the production method for Cyan Toner 1 except that the formulation was changed to the materials and the addition amounts described above. Table 2 shows the physical properties of Cyan Toner 25.

Cyan Toner Production Example 26

| | |
|---|---|
| Styrene | 79.0 parts by mass |
| n-butyl acrylate | 21.0 parts by mass |
| t-dodecyl mercaptan (loaded at the stage of the preparation of a solution) | 1.0 part by mass |
| Toluene | 2.5 parts by mass |
| FCA1001NS (manufactured by FUJIKURA KASEI CO., LTD.) | 1.0 part by mass |
| Polar resin 9: styrene-n-butyl acrylate-methacrylic acid-methyl methacrylate copolymer (Copolymerization ratio = 80.6:15.0:1.7:2.7, Mp = 10,000, Mw = 10,000, Tg = 80° C., acid value = 12.0 mgKOH/g, Mw/Mn = 2.1, amount of remaining styrene = 80 ppm) | 20.0 parts by mass |
| C.I. Pigment Blue 15:3 | 7.0 parts by mass |
| BONTRON E-88 (manufactured by Orient Chemical Industries, LTD.) | 1.0 part by mass |
| HNP-10 (melting point 75° C.; manufactured by Nippon Seiro Co., Ltd.) | 10.0 parts by mass |
| Di-t-butyl ether (Ether Compound 1) | 0.05 part by mass |
| 2,2'-azobis(2,4-dimethylvaleronitrile) | 8.0 parts by mass |

Cyan Toner 26 was obtained by the same method as the production method for Cyan Toner 1 except that the formulation was changed to the materials and the addition amounts described above. Table 2 shows the physical properties of Cyan Toner 26.

Cyan Toner Production Example 27

A toner was produced in the same manner as in Cyan Toner Production Example 1 except that: the addition amount of tricalcium phosphate was changed from 9.0 parts by mass to 30.0 parts by mass; and the formulation was changed as described below.

| | |
|---|---|
| Styrene | 70.0 parts by mass |
| n-butyl acrylate | 30.0 parts by mass |

-continued

| | |
|---|---|
| Toluene | 2.5 parts by mass |
| FCA1001NS (manufactured by FUJIKURA KASEI CO., LTD.) | 1.0 part by mass |
| Polystyrene (Mp = 69,000, Mw = 68,000, Tg = 100° C., acid value = 0 mgKOH/g, Mw/Mn = 2.1, amount of remaining styrene = 95 ppm) | 20.0 parts by mass |
| C.I. Pigment Blue 15:3 | 7.0 parts by mass |
| BONTRON E-88 (manufactured by Orient Chemical Industries, LTD.) | 1.0 part by mass |
| HNP-10 (melting point 75° C.; manufactured by Nippon Seiro Co., Ltd.) | 10.0 parts by mass |
| Di-t-butyl ether (Ether Compound 1) | 0.05 part by mass |
| 2,2'-azobis(2,4-dimethylvaleronitrile) | 8.0 parts by mass |

Table 2 shows the physical properties of Cyan Toner 27.

Cyan Toner Production Example 28

| | |
|---|---|
| Styrene | 72.5 parts by mass |
| n-butyl acrylate | 27.5 parts by mass |
| Divinylbenzene (loaded at the stage of the preparation of a solution) | 0.12 part by mass |
| Toluene | 2.5 parts by mass |
| FCA1001NS (manufactured by FUJIKURA KASEI CO., LTD.) | 1.0 part by mass |
| Polar resin 8 described above | 20.0 parts by mass |
| C.I. Pigment Blue 15:3 | 7.0 parts by mass |
| BONTRON E-88 (manufactured by Orient Chemical Industries, LTD.) | 1.0 part by mass |
| HNP-10 (melting point 75° C.; manufactured by Nippon Seiro Co., Ltd.) | 10.0 parts by mass |
| Di-t-butyl ether (Ether Compound 1) | 0.05 part by mass |
| 2,2'-azobis(2,4-dimethylvaleronitrile) | 8.0 parts by mass |

Cyan Toner 28 was obtained by the same method as the production method for Cyan Toner 1 except that the formulation was changed to the materials and the addition amounts described above. Table 2 shows the physical properties of Cyan Toner 28.

Cyan Toner Production Example 29

| | |
|---|---|
| Styrene | 70.0 parts by mass |
| n-butyl acrylate | 30.0 parts by mass |
| Toluene | 2.5 parts by mass |
| FCA1001NS (manufactured by FUJIKURA KASEI CO., LTD.) | 1.0 part by mass |
| Polar resin 10: styrene-methacrylic acid-methyl methacrylate copolymer (Copolymerization ratio = 87.4:9.9:2.7, Mp = 52,000, Mw = 50,000, Tg = 101° C., acid value = 70.0 mgKOH/g, Mw/Mn = 2.1, amount of remaining styrene = 95 ppm) | 20.0 parts by mass |
| C.I. Pigment Blue 15:3 | 7.0 parts by mass |
| BONTRON E-88 (manufactured by Orient Chemical Industries, LTD.) | 1.0 part by mass |
| HNP-10 (melting point 75° C.; manufactured by Nippon Seiro Co., Ltd.) | 10.0 parts by mass |
| Di-t-butyl ether (Ether Compound 1) | 0.05 part by mass |
| 2,2'-azobis(2,4-dimethylvaleronitrile) | 8.0 parts by mass |

Cyan Toner 29 was obtained by the same method as the production method for Cyan Toner 1 except that the formulation was changed to the materials and the addition amounts described above. Table 2 shows the physical properties of Cyan Toner 29.

Cyan Toner Production Example 30

| | |
|---|---|
| Styrene | 70.0 parts by mass |
| n-butyl acrylate | 30.0 parts by mass |
| Toluene | 2.5 parts by mass |
| FCA1001NS (manufactured by FUJIKURA KASEI CO., LTD.) | 1.0 part by mass |
| Saturated polyester resin [produced from terephthalic acid and propylene oxide-modified bisphenol A] (Mp = 9,000, Mw = 8,900, Tg = 72° C., acid value = 12.0 mgKOH/g, Mw/Mn = 2.2) | 20.0 parts by mass |
| C.I. Pigment Blue 15:3 | 7.0 parts by mass |
| BONTRON E-88 (manufactured by Orient Chemical Industries, LTD.) | 1.0 part by mass |
| HNP-10 (melting point 75° C.; manufactured by Nippon Seiro Co., Ltd.) | 10.0 parts by mass |
| Di-t-butyl ether (Ether Compound 1) | 0.05 part by mass |
| 2,2'-azobis(2,4-dimethylvaleronitrile) | 8.0 parts by mass |

Cyan Toner 30 was obtained by the same method as the production method for Cyan Toner 1 except that the formulation was changed to the materials and the addition amounts described above. Table 2 shows the physical properties of Cyan Toner 30.

Magenta Toner Production Example 1

Magenta Toner 1 was obtained in the same manner as in Cyan Toner 16 except that: C.I. Pigment Blue 15:3 was changed to C.I. Pigment Red 122; and the addition amount of the pigment was changed to 10 parts by mass. Table 2 shows the physical properties of Magenta Toner 1.

Magenta Toner Production Example 2

Black Toner 2 was obtained in the same manner as in Cyan Toner 16 except that: C.I. Pigment Blue 15:3 was changed to C.I. Pigment Red 122; and the addition amount of the pigment was changed to 10 parts by mass. Table 2 shows the physical properties of Magenta Toner 2.

Yellow Toner Production Example 1

Yellow Toner 1 was obtained in the same manner as in Cyan Toner 1 except that C.I. Pigment Blue 15:3 was changed to C.I. Pigment Yellow 93. Table 2 shows the physical properties of Yellow Toner 1.

Yellow Toner Production Example 2

Yellow Toner 2 was obtained in the same manner as in Cyan Toner 16 except that C.I. Pigment Blue 15:3 was changed to C.I. Pigment Yellow 93. Table 2 shows the physical properties of Yellow Toner 2.

Black Toner Production Example 1

Black Toner 1 was obtained in the same manner as in Cyan Toner 1 except that: C.I. Pigment Blue 15:3 was changed to carbon black; and the addition amount of the pigment was changed to 8 parts by mass. Table 2 shows the physical properties of Black Toner 1.

Black Toner Production Example 2

Black Toner 2 was obtained in the same manner as in Cyan Toner 16 except that: C.I. Pigment Blue 15:3 was changed to carbon black; and the addition amount of the pigment was changed to 8 parts by mass. Table 2 shows the physical properties of Black Toner 2.

TABLE 2

| | | Polar resin | | Polymer having sulfonic group | | Ether Compound | | | Toner | | | |
|---|---|---|---|---|---|---|---|---|---|---|---|---|
| | Binder resin | Kind | Part (s) | Kind | Part (s) | Kind | Part (s) | Wax | DSC peak P1 (° C.) | TgA (° C.) | P1 − TgA (° C.) | Melt viscosity (Pa · s) |
| Cyan Toner 1 | Vinyl | Resin 1 | 20 | FCA1001 | 1.0 | No. 1 | 0.05 | HNP10 | 75 | 52 | 23 | 15000 |
| Cyan Toner 2 | Vinyl | Resin 1 | 20 | FCA1001 | 1.0 | No. 2 | 0.05 | WEP-3 | 73 | 52 | 21 | 15000 |
| Cyan Toner 3 | Vinyl | Resin 1 | 20 | FCA1001 | 1.0 | No. 3 | 0.05 | HNP10 | 75 | 52 | 23 | 15000 |
| Cyan Toner 4 | Vinyl | Resin 1 | 20 | FCA1001 | 1.0 | No. 1 | 0.05 | HNP10 | 75 | 52 | 23 | 15000 |
| Cyan Toner 5 | Vinyl | Resin 2 | 20 | FCA1001 | 1.0 | No. 1 | 0.05 | HNP10 | 75 | 52 | 23 | 15000 |
| Cyan Toner 6 | Vinyl | Resin 3 | 20 | FCA1001 | 1.0 | No. 1 | 0.05 | HNP10 | 75 | 52 | 23 | 15000 |
| Cyan Toner 7 | Vinyl | Resin 4 | 20 | FCA1001 | 1.0 | No. 1 | 0.05 | HNP10 | 75 | 52 | 23 | 15000 |
| Cyan Toner 8 | Vinyl | Resin 5 | 20 | FCA1001 | 1.0 | No. 1 | 0.05 | HNP10 | 75 | 52 | 23 | 15000 |
| Cyan Toner 9 | Vinyl | Resin 1 | 40 | FCA1001 | 1.0 | No. 1 | 0.05 | HNP10 | 75 | 52 | 23 | 24000 |
| Cyan Toner 10 | Vinyl | Resin 1 | 20 | FCA1001 | 1.0 | No. 1 | 0.05 | HiMic1045 | 70 | 55 | 15 | 14000 |
| Cyan Toner 11 | Vinyl | Resin 1 | 4 | FCA1001 | 1.0 | No. 1 | 0.05 | HNP10 | 75 | 52 | 23 | 5000 |
| Cyan Toner 12 | Vinyl | Resin 6 | 20 | FCA1001 | 1.0 | No. 1 | 0.05 | HNP10 | 75 | 60 | 15 | 25000 |
| Cyan Toner 13 | Vinyl | Resin 1 | 20 | FCA1001 | 1.0 | — | — | HNP10 | 75 | 52 | 23 | 15000 |
| Cyan Toner 14 | Vinyl | Resin 7 | 10 | FCA1001 | 1.0 | No. 1 | 0.05 | HNP10 | 75 | 52 | 23 | 25000 |
| Cyan Toner 15 | Vinyl | Resin 8 | 20 | FCA1001 | 1.0 | No. 1 | 0.05 | HNP0190 | 90 | 40 | 50 | 8000 |
| Cyan Toner 16 | Vinyl | Resin 1 | 20 | FCA1001 | 1.0 | No. 1 | 0.05 | PW2000PE | 120 | 50 | 70 | 16000 |
| Cyan Toner 17 | Vinyl | Resin 6 | 20 | FCA1001 | 1.0 | No. 1 | 0.05 | HNP0190 | 90 | 60 | 30 | 30000 |
| Cyan Toner 18 | Vinyl | Resin 1 | 20 | FCA1001 | 1.0 | No. 1 | 0.05 | HNP10 | 75 | 52 | 23 | 15000 |
| Cyan Toner 19 | Vinyl | Resin 1 | 20 | FCA1001 | 1.0 | No. 1 | 0.05 | HNP10 | 75 | 52 | 23 | 15000 |
| Cyan Toner 20 | Vinyl | Resin 1 | 20 | — | — | No. 1 | 0.05 | HNP10 | 75 | 52 | 23 | 15000 |
| Cyan Toner 21 | Vinyl | Resin 1 | 20 | FCA1001 | 0.3 | No. 1 | 0.05 | HNP10 | 75 | 52 | 23 | 15000 |
| Cyan Toner 22 | Vinyl | Resin 1 | 20 | FCA1001 | 2.0 | No. 1 | 0.05 | HNP10 | 75 | 52 | 23 | 15000 |

TABLE 2-continued

| | | | | | | | | | | | | |
|---|---|---|---|---|---|---|---|---|---|---|---|---|
| Magenta Toner 1 | Vinyl | Resin 1 | 20 | FCA1001 | 1.0 | No. 1 | 0.05 | HNP10 | 75 | 52 | 23 | 15000 |
| Yellow Toner 1 | Vinyl | Resin 1 | 20 | FCA1001 | 1.0 | No. 1 | 0.05 | HNP10 | 75 | 52 | 23 | 15000 |
| Black Toner 1 | Vinyl | Resin 1 | 20 | FCA1001 | 1.0 | No. 1 | 0.05 | HNP10 | 75 | 52 | 23 | 15000 |
| Cyan Toner 23 | Vinyl | Resin 1 | 20 | FCA1001 | 1.0 | No. 1 | 0.05 | HNP0190 | 90 | 30 | 60 | 7000 |
| Cyan Toner 24 | Vinyl | — | — | FCA1001 | 1.0 | No. 1 | 0.05 | HNP10 | 75 | 52 | 23 | 5500 |
| Cyan Toner 25 | Vinyl | Resin 8 | 20 | FCA1001 | 1.0 | No. 1 | 0.05 | HNP10 | 75 | 52 | 23 | 4500 |
| Cyan Toner 26 | Vinyl | Resin 9 | 20 | FCA1001 | 1.0 | No. 1 | 0.05 | HNP10 | 75 | 62 | 13 | 22000 |
| Cyan Toner 27 | Vinyl | Poly styrene | 20 | FCA1001 | 1.0 | No. 1 | 0.05 | HNP10 | 75 | 52 | 23 | 15000 |
| Cyan Toner 28 | Vinyl | Resin 8 | 20 | FCA1001 | 1.0 | No. 1 | 0.05 | HNP10 | 75 | 52 | 23 | 50000 |
| Cyan Toner 29 | Vinyl | Resin 10 | 20 | FCA1001 | 1.0 | No. 1 | 0.05 | HNP10 | 75 | 52 | 23 | 14000 |
| Cyan Toner 30 | Vinyl | Polyester | 20 | FCA1001 | 1.0 | No. 1 | 0.05 | HNP10 | 75 | 47 | 28 | 7000 |
| Magenta Toner 2 | Vinyl | Resin 1 | 20 | FCA1001 | 1.0 | No. 1 | 0.05 | HNP0190 | 90 | 30 | 60 | 7000 |
| Yellow Toner 2 | Vinyl | Resin 1 | 20 | FCA1001 | 1.0 | No. 1 | 0.05 | HNP0190 | 90 | 30 | 60 | 7000 |
| Black Toner 2 | Vinyl | Resin 1 | 20 | FCA1001 | 1.0 | No. 1 | 0.05 | HNP0190 | 90 | 30 | 60 | 7000 |

| | Toner | | | | | | | | |
|---|---|---|---|---|---|---|---|---|---|
| | L (μm) | Va (μm/s) | Vb (μm/s) | Main peak molecular weight MpA | Weight-average particle diameter D4 (μm) | Change ratio of D4 (%) | Degree of agglomeration after left to stand at 50° C. | Avarage circularity | Average circularity (%) |
| Cyan Toner 1 | 0.40 | 0.048 | 0.072 | 30000 | 6.2 | 110 | 5 | 0.980 | 10 |
| Cyan Toner 2 | 0.40 | 0.048 | 0.072 | 30000 | 6.2 | 112 | 8 | 0.978 | 11 |
| Cyan Toner 3 | 0.40 | 0.048 | 0.072 | 30000 | 6.4 | 114 | 12 | 0.976 | 12 |
| Cyan Toner 4 | 0.40 | 0.048 | 0.072 | 30000 | 6.4 | 135 | 30 | 0.960 | 20 |
| Cyan Toner 5 | 0.50 | 0.056 | 0.084 | 29000 | 6.4 | 116 | 15 | 0.978 | 12 |
| Cyan Toner 6 | 0.30 | 0.035 | 0.053 | 30000 | 6.4 | 110 | 8 | 0.978 | 10 |
| Cyan Toner 7 | 0.33 | 0.038 | 0.057 | 29000 | 6.2 | 105 | 10 | 0.982 | 15 |
| Cyan Toner 8 | 0.55 | 0.058 | 0.087 | 30000 | 6.6 | 130 | 30 | 0.968 | 15 |
| Cyan Toner 9 | 0.25 | 0.030 | 0.045 | 33000 | 8.0 | 110 | 10 | 0.976 | 18 |
| Cyan Toner 10 | 0.40 | 0.05 | 0.068 | 29000 | 6.4 | 111 | 11 | 0.978 | 12 |
| Cyan Toner 11 | 0.60 | 0.070 | 0.090 | 10000 | 6.6 | 150 | 50 | 0.976 | 12 |
| Cyan Toner 12 | 0.20 | 0.020 | 0.030 | 40000 | 6.6 | 110 | 10 | 0.976 | 20 |
| Cyan Toner 13 | 0.40 | 0.048 | 0.072 | 30000 | 6.6 | 110 | 5 | 0.980 | 10 |
| Cyan Toner 14 | 0.40 | 0.050 | 0.075 | 40000 | 6.9 | 120 | 14 | 0.976 | 25 |
| Cyan Toner 15 | 0.60 | 0.085 | 0.090 | 22000 | 6.6 | 155 | 80 | 0.966 | 20 |
| Cyan Toner 16 | 0.40 | 0.048 | 0.072 | 31000 | 6.2 | 110 | 8 | 0.960 | 26 |
| Cyan Toner 17 | 0.20 | 0.020 | 0.025 | 40000 | 6.6 | 110 | 10 | 0.960 | 25 |
| Cyan Toner 18 | 0.60 | 0.075 | 0.090 | 30000 | 6.2 | 150 | 65 | 0.975 | 11 |
| Cyan Toner 19 | 0.40 | 0.070 | 0.091 | 30000 | 6.2 | 130 | 45 | 0.979 | 11 |
| Cyan Toner 20 | 0.40 | 0.060 | 0.090 | 30000 | 6.8 | 135 | 60 | 0.972 | 20 |
| Cyan Toner 21 | 0.40 | 0.050 | 0.075 | 30000 | 6.9 | 115 | 10 | 0.975 | 20 |
| Cyan Toner 22 | 0.40 | 0.046 | 0.069 | 30000 | 6.0 | 116 | 10 | 0.975 | 20 |
| Magenta Toner 1 | 0.40 | 0.049 | 0.074 | 28000 | 6.6 | 110 | 5 | 0.980 | 10 |
| Yellow Toner 1 | 0.40 | 0.049 | 0.074 | 27000 | 6.6 | 110 | 5 | 0.980 | 10 |
| Black Toner 1 | 0.40 | 0.048 | 0.067 | 27500 | 6.6 | 110 | 5 | 0.980 | 10 |
| Cyan Toner 23 | 0.40 | 0.085 | 0.090 | 22000 | 6.6 | 190 | 90 | 0.966 | 25 |
| Cyan Toner 24 | 1.20 | 0.090 | 0.090 | 21000 | 7.0 | 180 | 90 | 0.968 | 20 |
| Cyan Toner 25 | 0.60 | 0.090 | 0.090 | 9000 | 6.6 | 155 | 82 | 0.974 | 26 |
| Cyan Toner 26 | 0.55 | 0.080 | 0.090 | 35000 | 6.4 | 110 | 12 | 0.974 | 15 |
| Cyan Toner 27 | 1.00 | 0.080 | 0.090 | 30000 | 8.0 | 160 | 80 | 0.971 | 20 |
| Cyan Toner 28 | 0.60 | 0.015 | 0.023 | 45000 | 6.6 | 110 | 7 | 0.976 | 26 |
| Cyan Toner 29 | 0.30 | 0.038 | 0.057 | 28000 | 6.8 | 112 | 10 | 0.970 | 25 |
| Cyan Toner 30 | 0.60 | 0.080 | 0.090 | 21000 | 6.8 | 140 | 40 | 0.970 | 18 |
| Magenta Toner 2 | 0.40 | 0.086 | 0.090 | 21000 | 6.6 | 190 | 90 | 0.966 | 25 |
| Yellow Toner 2 | 0.40 | 0.086 | 0.090 | 21000 | 6.6 | 190 | 90 | 0.966 | 25 |
| Black Toner 2 | 0.40 | 0.085 | 0.090 | 21500 | 6.6 | 190 | 90 | 0.966 | 25 |

| | Cyclohexane insoluble matter. | | | | |
|---|---|---|---|---|---|
| | Amount of insoluble matter (%) | TgB (° C.) | Acid value (mgKOH/g) | Main peak molecular weight MpB | TgB − TgA (° C.) |
| Cyan Toner 1 | 15 | 102 | 12.0 | 69000 | 50.0 |
| Cyan Toner 2 | 15 | 102 | 12.0 | 69000 | 50.0 |
| Cyan Toner 3 | 15 | 102 | 12.0 | 69000 | 50.0 |
| Cyan Toner 4 | 15 | 102 | 12.0 | 69000 | 50.0 |
| Cyan Toner 5 | 15 | 80 | 12.0 | 69000 | 28.0 |
| Cyan Toner 6 | 15 | 120 | 12.0 | 44000 | 68.0 |
| Cyan Toner 7 | 15 | 102 | 40.0 | 69000 | 50.0 |
| Cyan Toner 8 | 15 | 102 | 5.0 | 69000 | 50.0 |

TABLE 2-continued

| | | | | | |
|---|---|---|---|---|---|
| Cyan Toner 9 | 30 | 102 | 12.0 | 69000 | 50.0 |
| Cyan Toner 10 | 15 | 102 | 12.0 | 69000 | 47.0 |
| Cyan Toner 11 | 3 | 102 | 12.0 | 69000 | 50.0 |
| Cyan Toner 12 | 15 | 102 | 12.0 | 250000 | 42.0 |
| Cyan Toner 13 | 15 | 102 | 12.0 | 69000 | 50.0 |
| Cyan Toner 14 | 8 | 102 | 12.0 | 500000 | 50.0 |
| Cyan Toner 15 | 15 | 80 | 12.0 | 10000 | 40.0 |
| Cyan Toner 16 | 15 | 102 | 12.0 | 69000 | 52.0 |
| Cyan Toner 17 | 15 | 102 | 12.0 | 250000 | 42.0 |
| Cyan Toner 18 | 15 | 102 | 12.0 | 69000 | 50.0 |
| Cyan Toner 19 | 15 | 102 | 12.0 | 69000 | 50.0 |
| Cyan Toner 20 | 15 | 102 | 12.0 | 69000 | 50.0 |
| Cyan Toner 21 | 15 | 102 | 12.0 | 69000 | 50.0 |
| Cyan Toner 22 | 15 | 102 | 12.0 | 69000 | 50.0 |
| Magenta Toner 1 | 15 | 102 | 12.0 | 69000 | 50.0 |
| Yellow Toner 1 | 15 | 102 | 12.0 | 69000 | 50.0 |
| Black Toner 1 | 15 | 102 | 12.0 | 69000 | 50.0 |
| Cyan Toner 23 | 15 | 102 | 12.0 | 69000 | 72.0 |
| Cyan Toner 24 | — | — | — | — | — |
| Cyan Toner 25 | 15 | 80 | 12.0 | 10000 | 28.0 |
| Cyan Toner 26 | 15 | 70 | 12.0 | 69000 | 8.0 |
| Cyan Toner 27 | 15 | 100 | 0.0 | 69000 | 48.0 |
| Cyan Toner 28 | 15 | 80 | 12.0 | 10000 | 28.0 |
| Cyan Toner 29 | 15 | 101 | 70.0 | 52000 | 49.0 |
| Cyan Toner 30 | 15 | 72 | 12.0 | 9000 | 25.0 |
| Magenta Toner 2 | 15 | 102 | 12.0 | 69000 | 72.0 |
| Yellow Toner 2 | 15 | 102 | 12.0 | 69000 | 72.0 |
| Black Toner 2 | 15 | 102 | 12.0 | 69000 | 72.0 |

Examples 1 to 26 and Comparative Examples 1 to 12

Each of the resultant toners was evaluated for the following items. Table 4 shows the results of the evaluation.

(Evaluation)

(I) Evaluation was performed with an image-forming apparatus based on a contact, one-component developing system shown in FIG. 4. 85 g of each of the above toners were loaded into a developing device of the apparatus, and were left to stand under a low-temperature, normal-humidity environment (10° C./50% RH) or a high-temperature, high-humidity environment (30° C./85% RH) for 24 hours. At that time, transfer paper was similarly left to stand. After that, density detection correction was performed, and then continuous output was performed with a chart having a print percentage of 1%. When images were output on a total of 100 or 2,000 sheets, developing efficiency, a circumferential streak and toner scattering, toner coat uniformity, transfer efficiency, uniformity in one page, and transfer uniformity were observed.

(i) Upon measurement of the developing efficiency, the power supply of the main body of the apparatus was forcedly turned off during the output of a solid whole image (having a toner laid-on level of 0.55 mg/cm$^2$). Then, the mass of the toner before development on a toner carrying member of the apparatus per unit area and the mass of the toner used in the development of an image on a photosensitive drum of the apparatus per unit area were measured, and the developing efficiency was calculated from the following equation.

Developing efficiency (%)=(amount of toner used in development of image on photosensitive drum/amount of toner on toner carrying member)×100

The evaluation was performed on the basis of the following criteria A, B, C, and D.

A: A developing efficiency of 95% or more was obtained under each of the low-temperature, normal-humidity environment and the high-temperature, high-humidity environment.

B: A developing efficiency of 88% or more and less than 95% was obtained under each of the low-temperature, normal-humidity environment and the high-temperature, high-humidity environment.

C: A developing efficiency of 80% or more and less than 88% was obtained under the high-temperature, high-humidity environment.

D: A developing efficiency of 80% or more and less than 88% was obtained under each of the low-temperature, normal-humidity environment and the high-temperature, high-humidity environment, or a developing efficiency of less than 80% was obtained under one of the environments.

(ii) Evaluation for a circumferential streak and toner scattering was performed as described below. After solid whole images (each having a toner laid-on level of 0.55 mg/cm$^2$) had been output on 2,000 sheets under the high-temperature, high-humidity environment, a developer container of the apparatus was dismantled, and the surface and edge of a toner carrying member of the apparatus were visually observed. Judgement criteria are described below.

A: After the output on the 2,000 sheets, neither a circumferential streak resulting from the interposition of foreign matter between a toner control member of the apparatus and the toner carrying member due to the breakdown or melt adhesion of the toner nor toner scattering resulting from the interposition of foreign matter between the toner carrying member and a toner edge seal occurred.

B: After the output on the 2,000 sheets, toner scattering resulting from the interposition of foreign matter between the toner carrying member and a toner edge seal was slightly observed.

C: After the output on the 2,000 sheets, toner scattering was slightly observed, and one to four circumferential streaks were also observed at the edge.

D: After the output on the 2,000 sheets, toner scattering was observed, and five or more circumferential streaks were also observed.

(iii) Upon observation of the toner coat uniformity, halftone whole images (each having a toner laid-on level of 0.20 mg/cm$^2$) were output on 100 or 2,000 sheets under the high-temperature, high-humidity environment. After that, the power supply of the main body of the apparatus was forcedly turned off, and dot reproducibility on a photosensitive drum of the apparatus used in development was observed. Evaluation was performed by the visual observation of a photograph of the photosensitive drum obtained with an optical microscope at a magnification of 100. Judgement criteria are described below.

A: The photosensitive drum was excellent in dot reproducibility even after the output on the 2,000 sheets.

B: The photosensitive drum showed slight disturbance of dot reproducibility after the output on the 2,000 sheets.

C: The photosensitive drum showed slight disturbance of dot reproducibility after the output on the 100 sheets.

D: The photosensitive drum showed serious disturbance of dot reproducibility after the output on the 100 sheets.

(iv) Upon measurement of the transfer efficiency, solid whole images (each having a toner laid-on level of 0.55 mg/cm$^2$) were output on 100 or 2,000 sheets under the high-temperature, high-humidity environment. After that, the power supply of the main body of the apparatus was forcedly turned off. Then, the mass of the toner before transfer on a photosensitive drum of the apparatus per unit area and the mass of the toner transferred onto a transfer material per unit area were measured, and the transfer efficiency was calculated from the following equation.

Transfer efficiency (%)=(amount of toner transferred onto transfer material/amount of toner on photosensitive drum)×100

Evaluation for the transfer efficiency is in conformance with criteria A, B, C, and D shown in Table 3 below.

TABLE 3

| | | | | | |
|---|---|---|---|---|---|
| Transfer efficiency after output on 2,000 sheets | 90% to | C | B | A | A |
| | 82 to 90% | D | C | B | B |
| | 75 to 82% | D | C | C | C |
| | to 75% | D | D | D | D |
| | | to 75% | 75 to 82% | 82 to 90% | 90% to |
| | | Transfer efficiency after output on 100 sheets | | | |

(v) Upon observation of image uniformity in one page, a halftone whole image (having a toner laid-on level of 0.20 mg/cm$^2$) and a solid whole image (having a toner laid-on level of 0.55 mg/cm$^2$) were transferred onto a Xerox4024 paper (75 g/cm$^2$) under the high-temperature, high-humidity environment, and the transfer material was evaluated for image uniformity. Judgement criteria are described below.

A: Each of the halftone and solid images was excellent in image uniformity in one page even after output on 2,000 sheets.

B: The halftone image showed slight deterioration of image uniformity in one page after output on 2,000 sheets.

C: Each of the halftone and solid images showed slight deterioration of image uniformity in one page after output on 2,000 sheets.

D: Each of the halftone and solid images showed deterioration of image uniformity in one page after output on 100 sheets.

(vi) Upon observation of the transfer uniformity, a halftone whole image having a toner laid-on level of 0.20 mg/cm$^2$ was transferred onto each of a Xerox4024 paper (75 g/cm$^2$) and a FOX RIVER BOND paper (90 g/cm$^2$) under the high-temperature, high-humidity environment, and each paper was evaluated for transfer uniformity. Judgement criteria are described below.

A: Good transfer uniformity was obtained even after output on 2,000 sheets of each of the Xerox4024 paper and the FOX RIVER BOND paper.

B: Transfer uniformity slightly deteriorated after output on 2,000 sheets of the FOX RIVER BOND paper.

C: Transfer uniformity slightly deteriorated after output on 100 sheets of the FOX RIVER BOND paper.

D: Transfer uniformity seriously deteriorated after output on 100 sheets of the FOX RIVER BOND paper.

(II) Evaluation for low-temperature fixability/winding performance at high temperatures 85 g of each of the toners described in the examples and the comparative examples were loaded into a developing device of an image-forming apparatus based on a contact, one-component developing system shown in FIG. 4, and were left to stand under a low-temperature, normal-humidity environment (10° C./50% RH) for 48 hours. After that, an image pattern in which square images each measuring 10 mm by 10 mm were uniformly placed at nine points in the entirety of transfer paper was formed on a FOX RIVER BOND paper (90 g/cm$^2$), and unfixed images were output. At that time, the images were each a monochromatic halftone image having a toner laid-on level of 0.2 mg/cm$^2$.

The unfixed images were fixed at a fixation speed of 150 mm/sec with an external fixing unit having the following characteristics: the temperature of the unit could be controlled, the unit had no oil application function, and the unit fixed the images by passing the images through a nip portion formed of a heat roller and a pressure roller as upper and lower rollers each having a diameter of 40 mm. It should be noted that, at that time, a fluorine material was used in each of the upper and lower rollers, and a nip width was 6 mm.

In addition, the initiation of fixation was judged as follows: fixed images (including an image offset at a low temperature) were each rubbed with lenz cleaning paper "DASPER(R)" (Ozu Paper Co. Ltd.) under a load of 50 g/cm$^2$. Then, the temperature at which the percentage by which the density of each of the images reduced after the rubbing was less than 20% was defined as a temperature for evaluating "low-temperature fixability".

In addition, winding performance at high temperatures was visually observed. The highest temperature at which one was able to pass the paper through the nip portion while preventing the paper from winding around each of the rollers was defined as a temperature for evaluating "winding performance at high temperatures".

TABLE 4

| | | Developing efficiency | Circum-ferential streak and toner scattering | Toner coat uniformity | Transfer efficiency | Uniformity in page | Transfer uniformity | Low-temparature fixability | Winding performance at high temparatures |
|---|---|---|---|---|---|---|---|---|---|
| Example 1 | Cyan Toner 1 | A | A | A | A | A | A | 130° C. | 210° C. |
| Example 2 | Cyan Toner 2 | A | A | A | A | A | A | 130° C. | 210° C. |
| Example 3 | Cyan Toner 3 | A | A | B | A | A | A | 130° C. | 210° C. |
| Example 4 | Cyan Toner 4 | A | A | A | B | A | A | 130° C. | 210° C. |
| Example 5 | Cyan Toner 5 | B | B | A | A | A | A | 130° C. | 210° C. |
| Example 6 | Cyan Toner 6 | A | A | A | A | A | A | 140° C. | 210° C. |
| Example 7 | Cyan Toner 7 | A | B | A | A | A | A | 130° C. | 210° C. |
| Example 8 | Cyan Toner 8 | A | A | A | A | A | A | 130° C. | 210° C. |
| Example 9 | Cyan Toner 9 | A | A | A | A | A | A | 130° C. | 210° C. |
| Example 10 | Cyan Toner 10 | A | A | A | A | A | A | 130° C. | 190° C. |
| Example 11 | Cyan Toner 11 | B | B | A | A | A | A | 130° C. | 210° C. |
| Example 12 | Cyan Toner 12 | A | A | A | A | A | A | 140° C. | 210° C. |
| Example 13 | Cyan Toner 13 | A | A | A | A | B | B | 130° C. | 210° C. |
| Example 14 | Cyan Toner 14 | B | B | A | A | A | A | 150° C. | 210° C. |
| Example 15 | Cyan Toner 15 | C | B | A | A | A | A | 130° C. | 190° C. |
| Example 16 | Cyan Toner 16 | B | B | A | B | A | A | 150° C. | 220° C. |
| Example 17 | Cyan Toner 17 | B | B | A | B | A | A | 150° C. | 210° C. |
| Example 18 | Cyan Toner 18 | C | B | A | A | A | A | 130° C. | 210° C. |
| Example 19 | Cyan Toner 19 | B | A | A | A | A | A | 130° C. | 210° C. |
| Example 20 | Cyan Toner 20 | B | B | A | B | A | A | 130° C. | 210° C. |
| Example 21 | Cyan Toner 21 | A | A | A | B | A | A | 130° C. | 210° C. |
| Example 22 | Cyan Toner 22 | A | A | A | B | A | A | 130° C. | 210° C. |
| Example 23 | Magenta Toner 1 | A | A | A | A | A | A | 130° C. | 210° C. |
| Example 24 | Yellow Toner 1 | A | A | A | A | A | A | 130° C. | 210° C. |
| Example 25 | Black Toner 1 | A | A | A | A | A | A | 130° C. | 210° C. |
| Comparative Example 1 | Cyan Toner 23 | D | D | D | D | C | D | 130° C. | 200° C. |
| Comparative Example 2 | Cyan Toner 24 | D | D | D | D | D | D | 130° C. | 180° C. |
| Comparative Example 3 | Cyan Toner 25 | D | D | D | D | D | D | 130° C. | 170° C. |
| Comparative Example 4 | Cyan Toner 26 | D | D | D | D | D | D | 170° C. | 210° C. |
| Comparative Example 5 | Cyan Toner 27 | C | C | C | D | D | D | 130° C. | 210° C. |
| Comparative Example 6 | Cyan Toner 28 | D | D | D | D | D | D | 170° C. | 220° C. |
| Comparative Example 7 | Cyan Toner 29 | B | B | B | B | C | B | 150° C. | 180° C. |
| Comparative Example 8 | Cyan Toner 30 | C | C | B | B | B | B | 130° C. | 190° C. |
| Comparative Example 9 | Magenta Toner 2 | D | D | D | D | C | D | 130° C. | 190° C. |
| Comparative Example 10 | Yellow Toner 2 | D | D | D | D | C | D | 130° C. | 190° C. |
| Comparative Example 11 | Black Toner 2 | D | D | D | D | C | D | 130° C. | 190° C. |
| Example 26 | Cyan Toner 1<br>Magenta Toner 1<br>Yellow Toner 1<br>Black Toner 1 | A | A | A | A | A | A | 130° C. | 210° C. |
| Comparative Example 12 | Cyan Toner 23<br>Magenta Toner 2<br>Yellow Toner 2<br>Black Toner 2 | D | D | D | D | C | D | 130° C. | 190° C. |

While the present invention has been described with reference to exemplary embodiments, it is to be understood that the invention is not limited is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-101922, filed Apr. 9, 2007, which is hereby incorporated by reference herein in its entirety.

What is claimed is:

1. A toner comprising toner particles each containing at least a binder resin, a wax, and a colorant, wherein:

the toner has (i) a glass transition temperature (TgA) measured with a differential scanning calorimeter of 40 to 60° C., (ii) a peak temperature (P1) of a highest endothermic peak measured with a differential scanning calorimeter of 70 to 120° C., and (iii) a viscosity at 100° C. measured by a flow tester heating method of 5,000 to 30,000 Pa·s;

cyclohexane (CHX) insoluble matter in tetrahydrofuran (THF) soluble matter of the toner has (i) a glass transition temperature (TgB) measured with a differential scanning calorimeter of 80 to 120° C. and (ii) an acid value of 5 to 40 mgKOH/g; and the glass transition temperature (TgA) and the glass transition temperature (TgB) satisfy the following formula (1)

$$25° C. \leqq (TgB - TgA) \leqq 70° C. \quad \text{Formula (1).}$$

2. A toner according to claim 1, wherein a temperature difference (P1−TgA) between the peak temperature (P1) and the glass transition temperature (TgA) satisfies the following formula (2)

$$15° C. \leqq (P1 - TgA) \leqq 70° C. \quad \text{Formula (2).}$$

3. A toner according to claim 1, wherein the peak temperature (P1) is 70 to 90° C., and a temperature difference (P1−TgA) between the peak temperature (P1) and the glass transition temperature (TgA) satisfies the following formula (3)

$$15° C. \leqq (P1 - TgA) \leqq 50° C. \quad \text{Formula (3).}$$

4. A toner according to claim 1, wherein the toner has a viscosity at 100° C. measured by the flow tester heating method of 5,000 to 25,000 Pa·s.

5. A toner according to claim 1, wherein, when a UV curable composition is caused to penetrate into the toner, a penetration thickness L (μm) at a penetration time of 5 seconds, an average penetration velocity Va (μm/s) at a penetration time in a range of 5 seconds or more to 10 seconds or less, and an average penetration velocity Vb (μm/s) at a penetration time in a range of 10 seconds or more to 15 seconds or less satisfy the following formulae (4) to (6)

$$0.20 \leqq L \leqq 0.60 \quad \text{Formula (4)}$$

$$0.02 \leqq Va \leqq 0.07 \quad \text{Formula (5)}$$

$$Va < Vb \quad \text{Formula (6).}$$

6. A toner according to claim 1, wherein a peak molecular weight (MpA) of a main peak in a molecular weight distribution of the tetrahydrofuran (THF) soluble matter of the toner measured by gel permeation chromatography (GPC) is 10,000 to 40,000.

7. A toner according to claim 1, wherein a peak molecular weight (MpB) of a main peak in a molecular weight distribution of the cyclohexane (CHX) insoluble matter in the tetrahydrofuran (THF) soluble matter of the toner measured by gel permeation chromatography (GPC) is 10,000 to 250,000.

8. A toner according to claim 1, wherein the toner particles are obtained in an aqueous medium.

9. A toner according to claim 8, wherein the toner particles comprise toner particles produced by dispersing a polymerizable monomer composition containing at least a polymerizable monomer, the wax, and the colorant in the aqueous medium to granulate the polymerizable monomer composition and polymerizing the polymerizable monomer.

10. A toner according to claim 1, wherein, when a dispersion liquid prepared by dispersing the toner particles in an aqueous medium free of a dispersion stabilizer is stirred at a temperature higher than the glass transition temperature (TgA) of the toner measured with a differential scanning calorimeter by 5° C. for 60 minutes, a change ratio represented by the following equation of a weight-average particle diameter (D4) of the toner particles after the stirring under heat to the weight-average particle diameter before the stirring under heat is 100 to 150%

Change ratio of weight-average particle diameter (D4) (%)=(weight-average particle diameter of toner particles after stirring under heat/weight-average particle diameter of toner particles before stirring under heat)×100.

11. A toner according to claim 10, wherein the change ratio of the weight-average particle diameter (D4) of the toner particles after the stirring under heat to the weight-average particle diameter before the stirring under heat is 100 to 130%.

12. A toner according to claim 1, wherein the toner has a degree of agglomeration after the toner has been left to stand at 50° C. and a humdity of 10% for 3 days of 50 or less.

13. A toner according to claim 1, further comprising a polar resin.

14. A toner according to claim 13, wherein the polar resin contains cyclohexane (CHX) insoluble matter.

15. A toner according to claim 13, wherein the polar resin comprises a vinyl polymer.

16. A toner according to claim 1, wherein the cyclohexane (CHX) insoluble matter in the tetrahydrofuran (THF) soluble matter of the toner accounts for 3 to 30 mass% of the toner.

17. A toner according to claim 1, wherein the binder resin comprises a vinyl polymer.

18. A toner according to claim 1, further comprising an ether compound represented by the following structural formula (1) or (2):

[Chem 1]

(1)

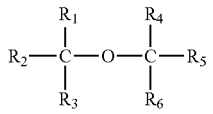

[Chem 2]

(2)

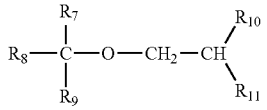

where $R_1$ to $R_{11}$ each represent an alkyl group having 1 to 6 carbon atoms, and may be identical to or different from one another.

19. A toner according to claim 1, further comprising a polymer having a sulfonic group, a sulfonate group, or a sulfonic acid ester group.

20. A toner according to claim 1, wherein the toner has an average circularity measured with a flow particle image analyzer of 0.960 to 1.000.

21. A toner according to claim 1, wherein the toner contains particles each having a particle diameter equal to or less than one third of a weight-average particle diameter (D4) of the toner particles at a ratio of 20 number% or less.

* * * * *